US009804553B2

(12) United States Patent
Hashimoto et al.

(10) Patent No.: US 9,804,553 B2
(45) Date of Patent: Oct. 31, 2017

(54) IMAGE FORMING APPARATUS AND DRUM UNIT

(71) Applicant: Brother Kogyo Kabushiki Kaisha, Nagoya-shi, Aichi-ken (JP)

(72) Inventors: Junichi Hashimoto, Toyohashi (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/087,276

(22) Filed: Mar. 31, 2016

(65) Prior Publication Data

US 2016/0291528 A1 Oct. 6, 2016

(30) Foreign Application Priority Data

Mar. 31, 2015 (JP) ..... 2015-074253
Mar. 31, 2015 (JP) ..... 2015-074255

(51) Int. Cl.
*G03G 21/10* (2006.01)

(52) U.S. Cl.
CPC ... *G03G 21/105* (2013.01); *G03G 2215/0141* (2013.01)

(58) Field of Classification Search
CPC ..... G03G 21/1814; G03G 21/1817; G03G 21/1821; G03G 21/105; G03G 21/12; G03G 2215/0141
See application file for complete search history.

(56) References Cited

U.S. PATENT DOCUMENTS 7,486,910 B2 2/2009 Kitozaki
2006/0104663 A1 5/2006 Kitozaki
2011/0103856 A1* 5/2011 Sato ..... G03G 21/12 399/360
2014/0037322 A1* 2/2014 Sato ..... G03G 21/105 399/101
2014/0126943 A1* 5/2014 Nakano ..... G03G 15/6511 399/360
2014/0334842 A1* 11/2014 Fukuchi ..... G03G 21/105 399/110

FOREIGN PATENT DOCUMENTS

JP 2006-139110 A 6/2006
JP 2010-008472 A 1/2010

* cited by examiner

*Primary Examiner* — Sevan A Aydin
(74) *Attorney, Agent, or Firm* — Banner & Witcoff, Ltd.

(57) ABSTRACT

An image forming apparatus includes a drum unit movable between an inside position inside a main body casing and an outside position outside the main body casing. The drum unit includes a photoconductive drum extending in an axial direction intersecting a moving direction of the drum unit from the outside position toward the inside position, and a transporter transporting toner removed by a cleaner toward a waste toner container. The transporter includes a transportation member transporting the toner along the moving direction, a transportation tube accommodating the transportation member and having an outlet, and a shutter movable between a closed position to close the outlet and an open position to open the outlet. The shutter includes a protruding section protruding along the axial direction from a shutter main body when the shutter is in the closed position, the protruding section being upstream of the photoconductive drum in the moving direction.

37 Claims, 17 Drawing Sheets

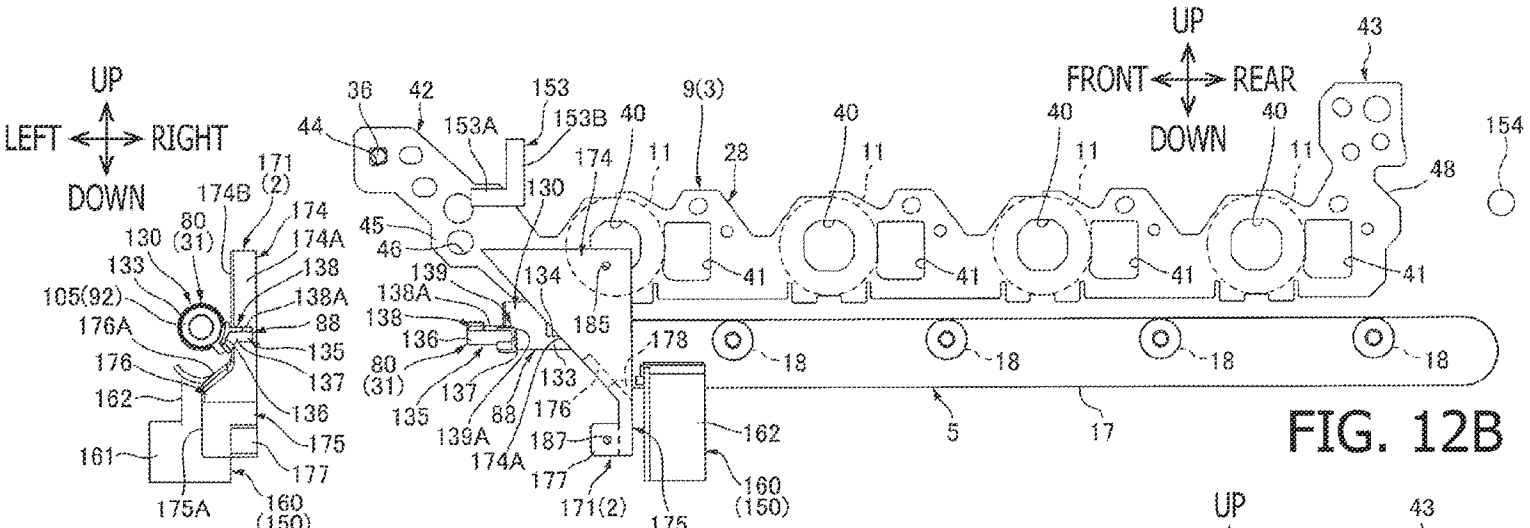
FIG. 12A
FIG. 12B
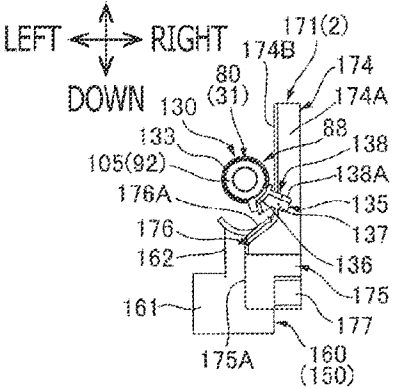
FIG. 12C
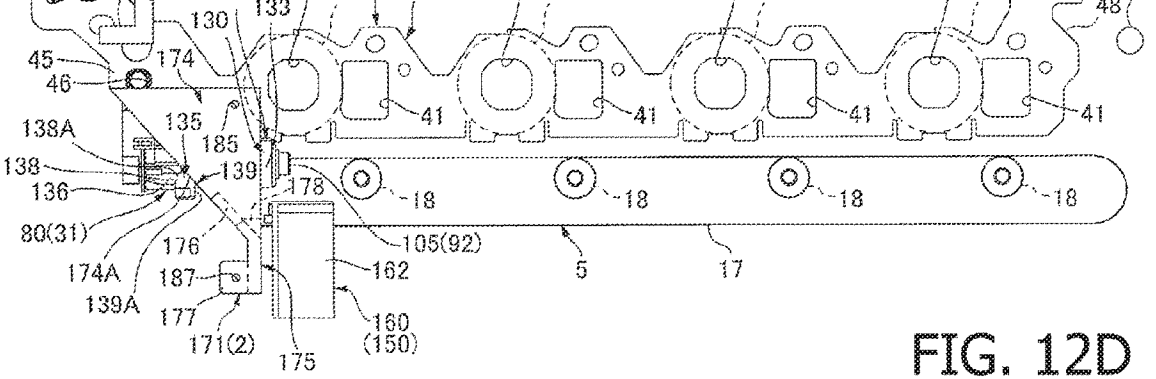
FIG. 12D

IMAGE FORMING APPARATUS AND DRUM UNIT

CROSS-REFERENCE TO RELATED APPLICATION

This application claims priority under 35 U.S.C. §119 from Japanese Patent Applications No. 2015-074253 filed on Mar. 31, 2015 and No. 2015-074255 filed on Mar. 31, 2015. The entire subject matters of the applications are incorporated herein by reference.

BACKGROUND

Technical Field

The following description relates to one or more aspects of an electrophotographic image forming apparatus and a drum unit attached thereto.

Related Art

As an electrophotographic image forming apparatus, a tandem-type image forming apparatus has been known that includes respective photoconductive drums corresponding to four colors of yellow, magenta, cyan, and black.

As such an image forming apparatus, an image forming apparatus has been proposed that includes an image forming unit detachably attached into the image forming apparatus. The image forming unit includes a plurality of process cartridges each of which supports a photoconductive drum and has a drum cleaner configured to remove toner remaining on a surface of the photoconductive drum. The image forming unit further includes a waste toner transportation tube configured to transport, to a waste toner container, waste toner removed from the surfaces of the photoconductive drums by the drum cleaners of the process cartridges.

SUMMARY

In the known image forming apparatus, since the image forming unit includes the waste toner container, there is an undesired problem that the image forming unit needs to be large in size.

Thus, as one of solutions to attain a more appropriate layout, it is considered to dispose the waste toner container inside the image forming apparatus, provide a shutter to the waste toner transportation tube, and open and close the shutter in conjunction with the image forming unit being attached into and detached from the image forming apparatus.

In this case, however, there might be caused a malfunction that toner leaks from the waste toner transportation tube as the shutter is unintentionally opened in response to the shutter coming into contact with a component when the image forming unit is attached or detached.

Further, in another known image forming apparatus, waste toner removed from a surface of each photoconductive drum by a corresponding drum cleaner is transferred to a waste toner transporter in an apparatus main body via an opening that is openable and closable by a shutter.

In this case, after each process cartridge is positioned relative to the apparatus main body, the shutter is rotated by a driving force from a motor, to open the opening.

At this time, the shutter rotates in response to receipt of a force applied in a particular direction in which the process cartridges are detached from the apparatus main body. Therefore, when the shutter is opened, the process cartridges are urged in the particular direction. Thus, there is an undesired problem that it is hard to precisely position the process cartridges relative to the apparatus main body.

Aspects of the present disclosure are advantageous to provide one or more improved techniques, for an image forming apparatus, which make it possible to open a shutter at appropriate timing and to position a drum unit relative to a main body casing.

According to aspects of the present disclosure, an image forming apparatus is provided, which includes a main body casing, a waste toner container, and a drum unit movable between an inside position inside the main body casing and an outside position outside the main body casing. The drum unit includes a photoconductive drum having an axis extending in an axial direction intersecting a moving direction of the drum unit from the outside position toward the inside position, a cleaner configured to remove toner remaining on a surface of the photoconductive drum, and a transporter configured to transport the toner removed by the cleaner toward the waste toner container. The transporter includes a transportation member configured to transport the toner removed by the cleaner, along the moving direction of the drum unit, a transportation tube configured to accommodate the transportation member, the transportation tube having an outlet configured to allow the toner transported by the transportation member to pass therethrough toward the waste toner container, and a shutter movable between a closed position to close the outlet and an open position to open the outlet. The shutter includes a shutter main body, and a protruding section configured to protrude along the axial direction from the shutter main body when the shutter is in the closed position, the protruding section being positioned upstream of the photoconductive drum in the moving direction of the drum unit from the outside position toward the inside position.

According to aspects of the present disclosure, further provided is an image forming apparatus including a main body casing having a first surface that faces in a first direction, and a drum unit movable between an inside position inside the main body casing and an outside position outside the main body casing, the drum unit being positioned relative to the main body casing in the first direction. The drum unit includes a photoconductive drum, a frame having an opening, an urging member, and a shutter rotatable between a closed position to close the opening and an open position to open the opening, the shutter being urged from the open position toward the closed position by an urging force from the urging member. The shutter includes a shutter main body, and a protruding section protruding outward from the shutter main body, the protruding section having a second surface configured to, when the shutter is in the open position, face in a second direction opposite to the first direction and be pressed by the first surface of the main body casing.

According to aspects of the present disclosure, further provided is a drum unit including a first photoconductive drum having an axis extending in an axial direction, a second photoconductive drum having an axis extending the axial direction, the drum unit being movable along a moving direction between an inside position inside a main body casing and an outside position outside the main body casing, the moving direction being a direction along which the first photoconductive drum and the second photoconductive drum are arranged, the moving direction being a direction intersecting the axial direction, a first cleaner configured to remove toner remaining on a surface of the first photoconductive drum, a second cleaner configured to remove toner remaining on a surface of the second photoconductive drum, and a transporter configured to transport the toner removed by the first cleaner and the toner removed by the second cleaner. The transporter includes a transportation member configured to transport the toner removed by the first cleaner and the toner removed by the second cleaner, along the moving direction, a transportation tube configured to accommodate the transportation member, the transportation tube having an outlet configured to allow the toner transported by the transportation member to pass therethrough, and a shutter movable between a closed position to close the outlet and an open position to open the outlet. The shutter includes a shutter main body, and a protruding section configured to protrude along the axial direction from the shutter main body when the shutter is in the closed position, the protruding section being positioned upstream of the photoconductive drum in the moving direction of the drum unit from the outside position toward the inside position.

According to aspects of the present disclosure, further provided is a drum unit movable between an inside position inside a main body casing and an outside position outside the main body casing, the main body casing having a first surface that faces in a first direction, the drum unit being positioned relative to the main body casing in the first direction, the drum unit including a first photoconductive drum, a second photoconductive drum, a frame having an opening, an urging member, and a shutter rotatable between a closed position to close the opening and an open position to open the opening, the shutter being urged from the open position toward the closed position by an urging force from the urging member. The shutter includes a shutter main body, and a protruding section protruding outward from the shutter main body, the protruding section having a second surface configured to, when the shutter is in the open position, face in a second direction opposite to the first direction and be pressed by the first surface of the main body casing.

BRIEF DESCRIPTION OF THE ACCOMPANYING DRAWINGS

FIG. 12A is a front view showing a state where the drum unit is in a first inside position within an inside position, in the illustrative embodiment according to one or more aspects of the present disclosure.

FIG. 12B is a right side view showing the state where the drum unit is in the first inside position within the inside position, in the illustrative embodiment according to one or more aspects of the present disclosure.

FIG. 12C is a front view showing a state where a curved surface of a protruding section is in contact with a first sliding surface of the contact section after contacting an inclined surface of the contact section, in the illustrative embodiment according to one or more aspects of the present disclosure.

FIG. 12D is a right side view showing the state where the curved surface of the protruding section is in contact with the first sliding surface of the contact section after contacting the inclined surface of the contact section, in the illustrative embodiment according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an illustrative embodiment according to aspects of the present disclosure will be described with reference to the accompanying drawings.

1. Overall Configuration of Image Forming Apparatus

Figure 1:
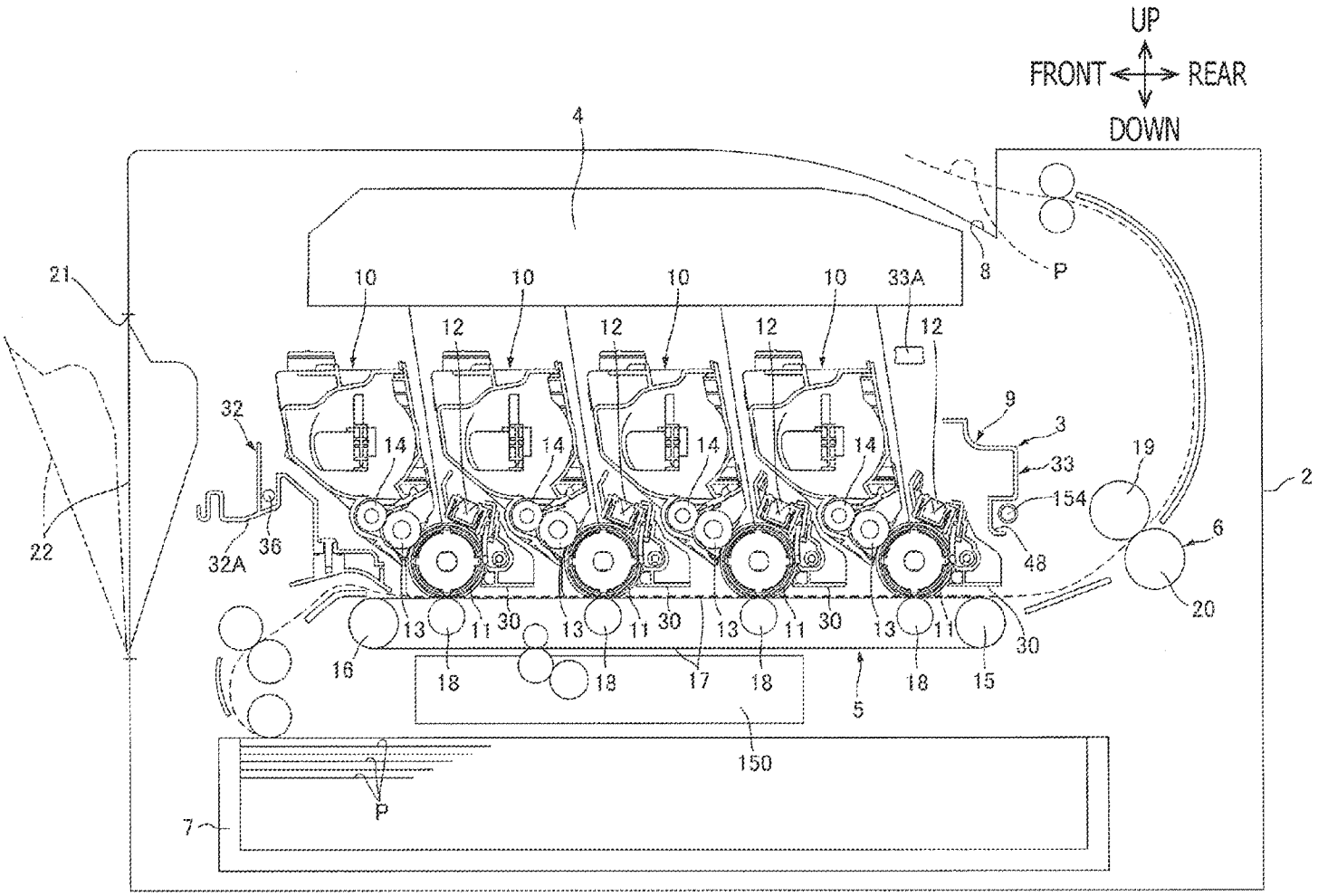
FIG. 1 is a cross-sectional side view of an image forming apparatus in an illustrative embodiment according to one or more aspects of the present disclosure.

As shown in FIG. 1, an image forming apparatus 1 is a horizontally-laid-type direct tandem color laser printer.

The image forming apparatus 1 includes a main body casing 2, a process unit 3, a scanner unit 4, a belt unit 5, and a fuser unit 6. The main body casing 2 has an opening 21.

The main body casing 2 is formed substantially in a box shape. The main body casing 2 includes a front cover 22, a feed tray 7, and a discharge tray 8.

The opening 21 is formed at a front end portion of the main body casing 2 in such a manner that an inside and an outside of the main body casing 2 communicate with each other via the opening 21 in a front-to-rear direction. Thus, the opening 21 allows the process unit 3 to pass therethrough.

The front cover 22 is disposed at the front end portion of the main body casing 2. The front cover 22 is formed substantially in a flat plate shape. The front cover 22 extends along a vertical direction. The front cover 22 is swingably supported by a front wall of the main body casing 2, with a lower end portion of the front cover 22 as a fulcrum. The front cover 22 is configured to open and close the opening 21.

The feed tray 7 is disposed at a bottom portion of the main body casing 2. The feed tray 7 is configured to accommodate sheets P.

The discharge tray 8 is disposed at an upper wall of the main body casing 2. The discharge tray 8 is recessed downward from an upper surface of the main body casing 2. The discharge tray 8 is configured to receive and support sheets P discharged thereon.

The process unit 3 is disposed at a middle portion of the main body casing 2. The process unit 3 is configured to slide along the front-to-rear direction between an inside position and an outside position. The inside position is a position inside the main body casing 2. The outside position is a position outside the main body casing 2. Further, in the inside position, the process unit 3 is movable between a first inside position shown in FIG. 12B and a second inside position shown in FIGS. 1 and 14D. As shown in FIG. 12B, in the first inside position, the process unit 3 is relatively farther away from the belt unit 5. Then, the process unit 3 moves downward from the first inside position to the second inside position. Thus, as shown in FIGS. 1 and 14D, in the second inside position, the process unit 3 is relatively closer to the belt unit 5. The process unit 3 includes a drum unit 9 and a plurality of development cartridges (in the illustrative embodiment, four development cartridges) 10.

The drum unit 9 includes a plurality of photoconductive drums (in the illustrative embodiment, four photoconductive drums) 11. Further, the drum unit 9 includes a plurality of scorotron chargers (in the illustrative embodiment, four scorotron chargers) 12.

Each photoconductive drum 11 is rotatably supported at a lower end portion of the process unit 3. The four photoconductive drums 11 correspond to yellow, magenta, cyan, and black, respectively. The four photoconductive drums 11 are arranged at intervals in an order of yellow, magenta, cyan, and black from the front to the rear, in parallel with each other. Each photoconductive drum 11 is formed substantially in a cylindrical shape extending along a left-to-right direction.

Each scorotron charger 12 is disposed apart from the corresponding photoconductive drum 11, on an upper rear side relative to the corresponding photoconductive drum 11.

The four development cartridges 10 have the same configuration, except for the colors of toner stored therein. Each development cartridge 10 is disposed above the corresponding photoconductive drum 11. Each development cartridges 10 includes a development roller 13 and a supply roller 14.

Each development roller 13 is rotatably supported to be exposed rearward, at a lower end portion of the corresponding development cartridge 10. Each development roller 13 is disposed to contact an upper end portion of the corresponding photoconductive drum 11.

Each supply roller 14 is disposed on an upper front side relative to the corresponding development roller 13. Further, each supply roller 14 is disposed to contact an upper front end portion of the corresponding development roller 13.

The scanner unit 4 is disposed at an upper end portion of the main body casing 2. As indicated by a solid line in FIG. 1, the scanner unit 4 emits a laser beam toward the photoconductive drums 11 and exposes the photoconductive drums 11, based on image data.

The belt unit 5 is disposed below the process unit 3. The belt unit 5 includes a driving roller 15, a driven roller 16, a belt 17, and a plurality of transfer rollers (in the illustrative embodiment, four transfer rollers) 18.

The driving roller 15 is disposed at a rear end portion of the belt unit 5.

The driven roller 16 is disposed in front of the driving roller 15, to be spaced apart from and opposed to the driving roller 15 in the front-to-rear direction. Further, the driven roller 16 is disposed at a front end portion of the belt unit 5.

The belt 17 is wound around a pair of the driving roller 15 and the driven roller 16 such that an upper portion of the belt 17 contacts all of the photoconductive drums 11 when the drum unit 9 is located in the second inside position within the inside position. The belt 17 is configured to turn in such a manner that the upper portion of the belt 17 moves from the front to the rear in conjunction with rotations of the driving roller 15 and the driven roller 16.

Each transfer roller 18 is disposed to face the corresponding photoconductive drum 11 across the upper portion of the belt 17, below the corresponding photoconductive drum 11.

The fuser unit 6 is disposed behind (i.e., on a rear side relative to) the belt unit 5. The fuser unit 6 includes a heating roller 19 and a pressing roller 20. The pressing roller 20 is configured to contact the heating roller 19.

When the image forming apparatus 1 begins an image forming operation, a scorotron charger 12 evenly charges a surface of the corresponding photoconductive drum 11. Thereafter, the scanner unit 4 exposes the surface of the photoconductive drum 11. Thereby, an electrostatic latent image based on the image data is formed on the surface of the photoconductive drum 11.

Further, the supply roller 14 supplies the development roller 13 with toner in the development cartridge 10. At this time, the toner is positively charged by friction between the development roller 13 and the supply roller 14, and is carried on the development roller 13.

Then, the development roller 13 supplies the toner carried thereon to the electrostatic latent image formed on the surface of the photoconductive drum 11. Thereby, a toner image is carried on the surface of the photoconductive drum 11.

After being fed from the feed tray 7 toward an upper front side by rotations of rollers, sheets P are turned around toward an upper rear side, and are fed between the belt 17 and the photoconductive drum 11 for yellow on a sheet-by-sheet basis at predetermined timings. Thereafter, the sheets P are conveyed from the front to the rear by the belt 17. Each of the toner images is transferred onto a sheet P when the sheet P passes between the corresponding photoconductive drum 11 and the corresponding transfer roller 18.

After that, the sheet P is heated and pressed when passing between the heating roller 19 and the pressing roller 20. At this time, the toner images on the sheet P are thermally fixed onto the sheet P. Afterwards, the sheet P is discharged onto the discharge tray 8.

2. Details about Drum Unit

Figure 2:
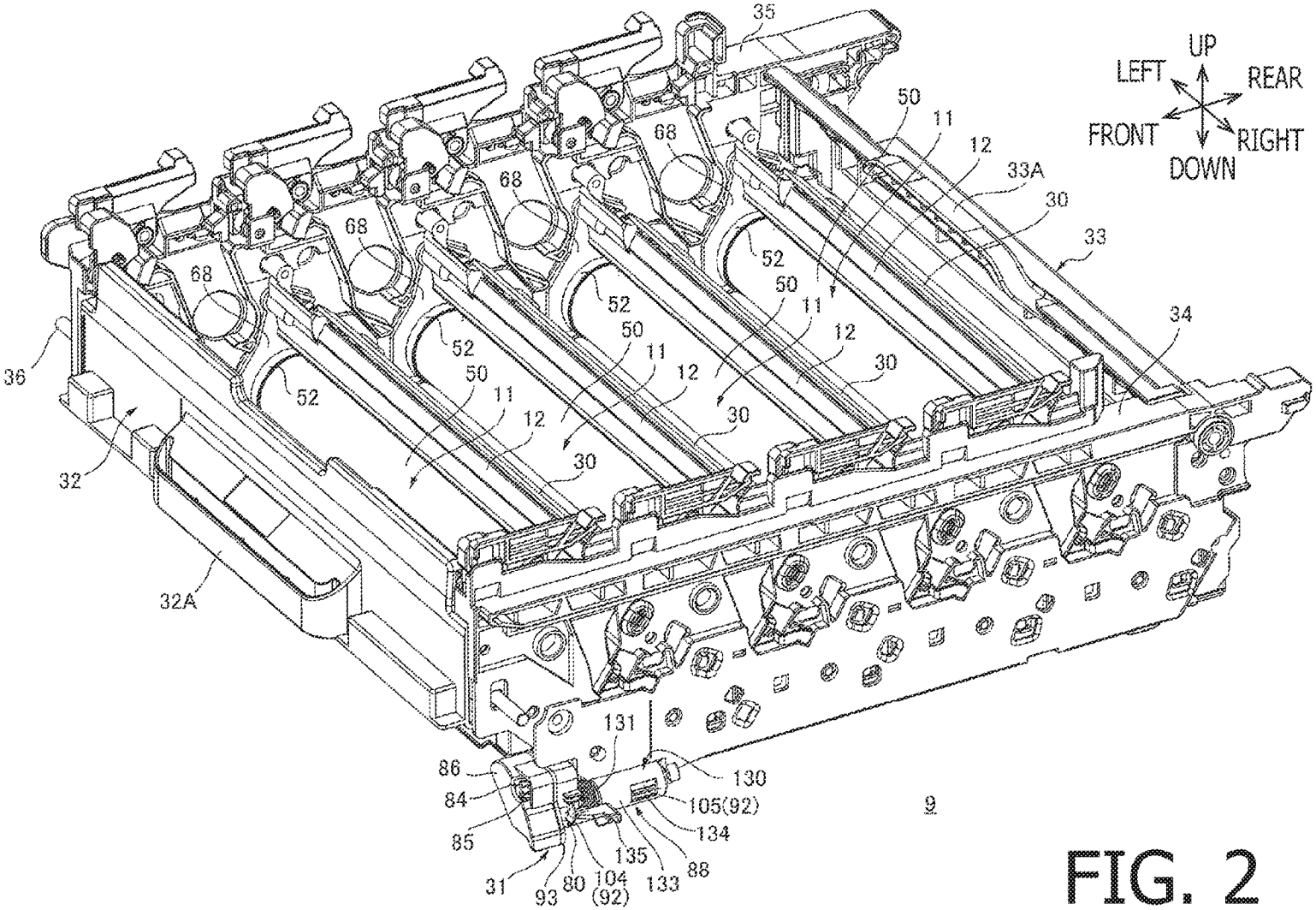
FIG. 2 is a perspective view, from an upper right side, of a drum unit of the image forming apparatus in the illustrative embodiment according to one or more aspects of the present disclosure.
Figure 6:
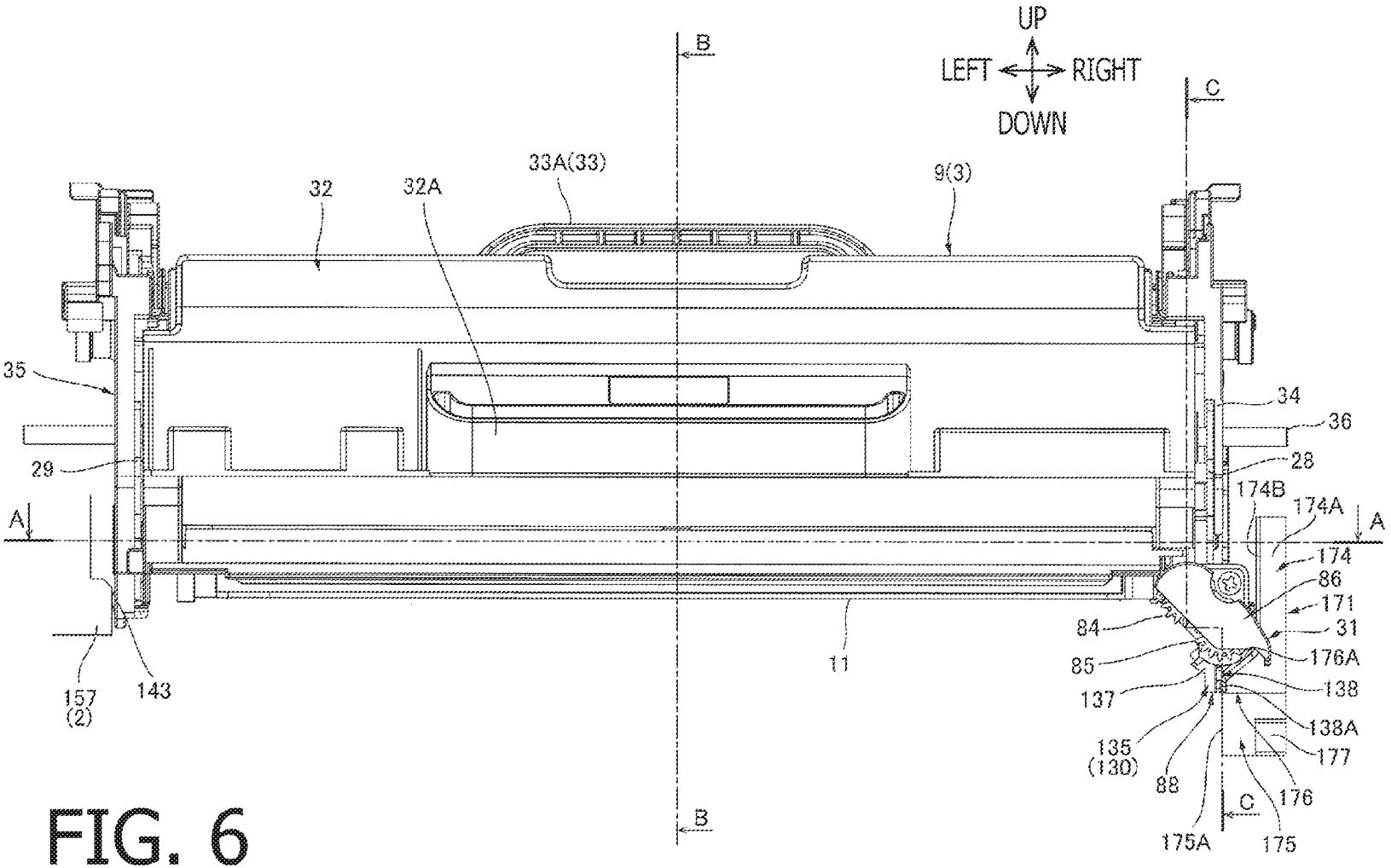
FIG. 6 is a front view showing a state where the drum unit is positioned relative to a main body casing, in the illustrative embodiment according to one or more aspects of the present disclosure.
Figure 7:
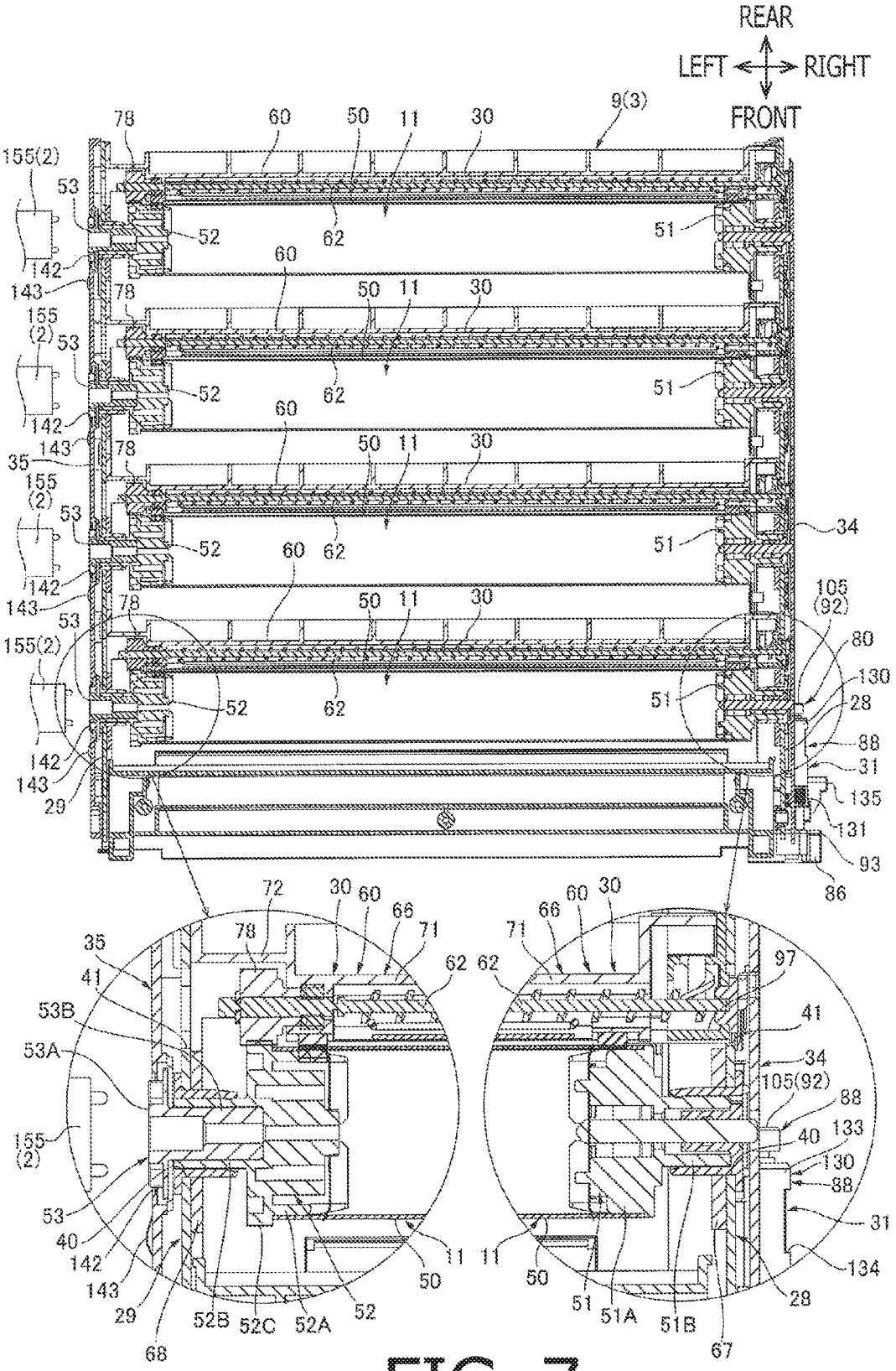
FIG. 7 is a cross-sectional view taken along line A-A shown in FIG. 6, in the illustrative embodiment according to one or more aspects of the present disclosure.

As shown in FIGS. 2, 6, and 7, the drum unit 9 is formed substantially in a rectangular frame shape in a plane view (i.e., when viewed from the top). The drum unit 9 includes a first positioning plate 28, a second positioning plate 29, the aforementioned four photoconductive drums 11, a plurality of cleaners (in the illustrative embodiment, four cleaners) 30, a transporter 31, a front plate 32, a rear plate 33, a first side plate 34, a second side plate 35, and a unit reference shaft 36. Each of the first and second positioning plates 28 and 29 has a plurality of holes (in the illustrative embodiment, four holes) 40 and a plurality of holes (in the illustrative embodiment, four holes) 41. The second side plate 35 has a plurality of holes (in the illustrative embodiment, four holes) 142.

(1) First Positioning Plate and Second Positioning Plate

Figure 4A:
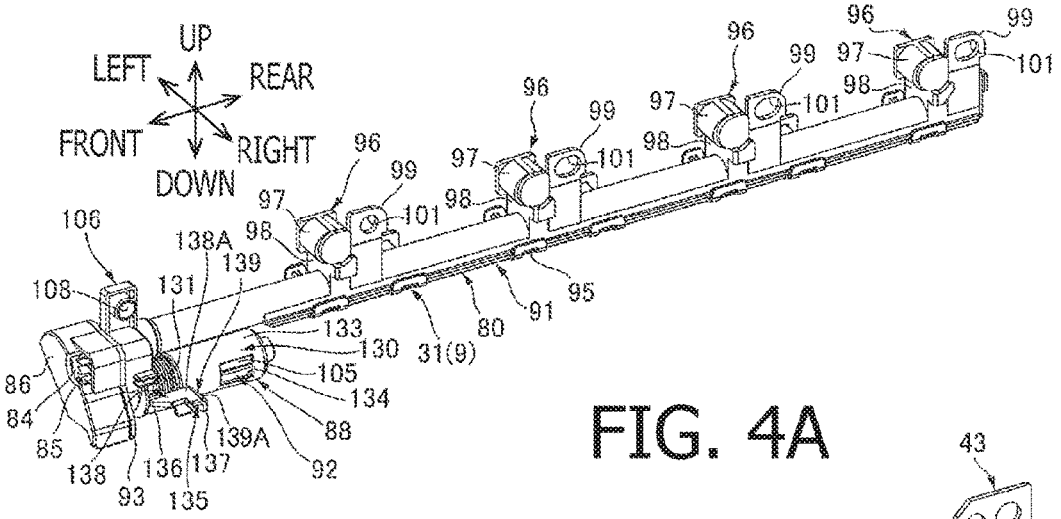
FIG. 4A is a perspective view, from an upper right side, of a transporter of the image forming apparatus in the illustrative embodiment according to one or more aspects of the present disclosure.
Figure 4B:
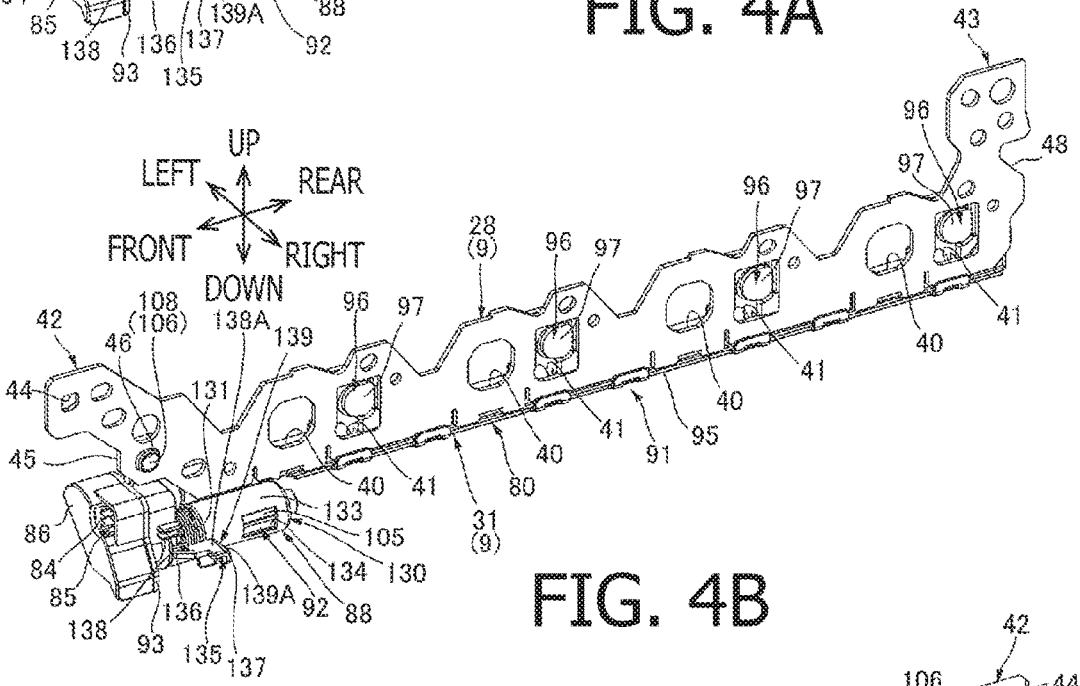
FIG. 4B is a perspective view, from the upper right side, of the transporter to which a first positioning plate is attached, in the illustrative embodiment according to one or more aspects of the present disclosure.

As shown in FIG. 7, the first positioning plate 28 is disposed at a right end portion of the drum unit 9. As shown in FIG. 4B, the first positioning plate 28 is formed substantially in a rectangular flat plate shape extending along the front-to-rear direction as a longitudinal direction thereof, in a side view (i.e., when viewed along the left-to-right direction). The first positioning plate 28 includes an inclined section 42 and a bent section 43. The inclined section 42 has a hole 44 through which the unit reference shaft 36 is inserted. The bent section 43 has a notch 48.

The four holes 40 are arranged at regular intervals in the front-to-rear direction. Each hole 40 is disposed to be positionally coincident with the corresponding photoconductive drum 11. Each hole 40 is formed substantially in a round shape in a side view.

The four holes 41 are arranged at regular intervals in the front-to-rear direction. Each hole 41 is disposed behind (i.e., on a rear side relative to) the corresponding hole 40. Each hole 41 is formed substantially in a rectangular shape in a side view.

The inclined section 42 is formed substantially in a rectangular flat plate shape extending toward an upper front side from a front end portion of the first positioning plate 28, in a side view. The inclined section 42 includes a bulging section 45 having a hole 46.

The hole 44 is disposed at an upper front end portion of the inclined section 42. The hole is substantially in a round shape in a side view.

The bulging section 45 is formed substantially in a triangular flat plate shape bulging toward a lower front side from a substantially middle portion of the inclined section 42 in a direction from an upper front side to a lower rear side, in a side view.

The hole 46 is disposed at a continuous joint portion through which the bulging section 45 and the inclined section are continuously connected with each other. The hole 46 is formed substantially in a round shape in a side view.

The bent section 43 is formed substantially in a rectangular flat shape extending upward from a rear end portion of the first positioning plate 28, in a side view.

The notch 48 is disposed at a rear end portion of the bent section 43. The notch 48 is formed as being cut off frontward from a rear end portion of the bent section 43. In other words, the notch 48 is formed substantially in a V-shape with an open rear end portion in a side view.

Figure 8:
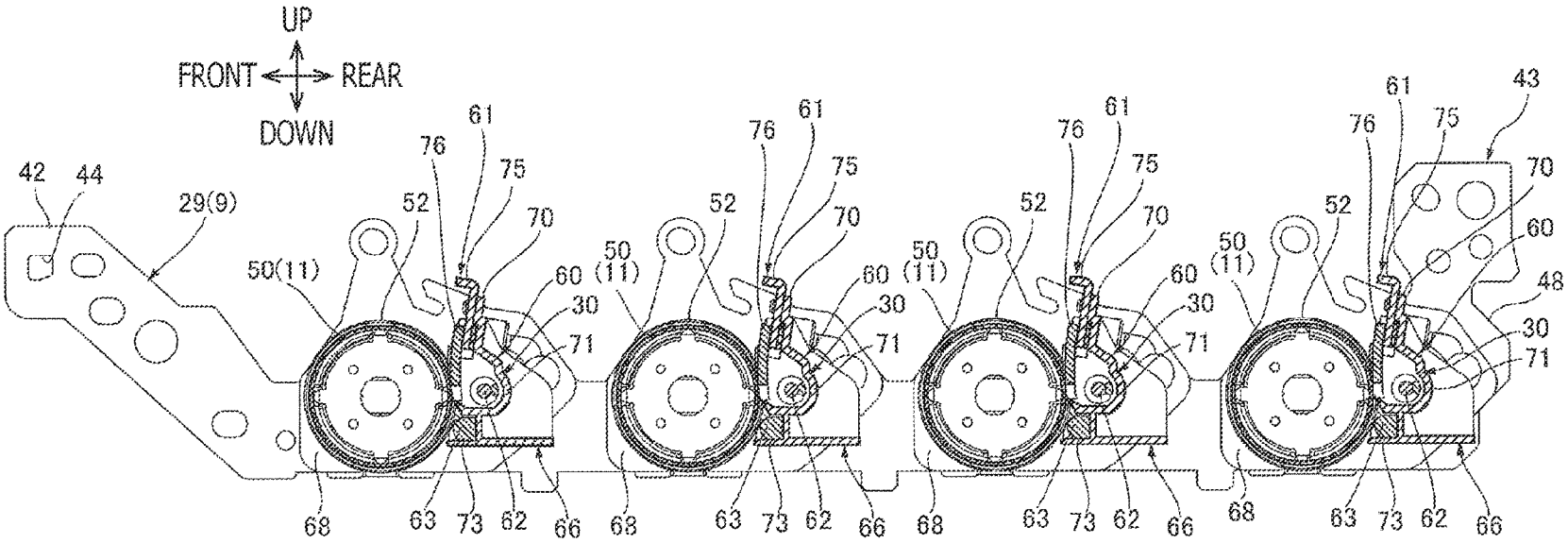
FIG. 8 is a cross-sectional view taken along line B-B shown in FIG. 6, without elements shown other than photoconductive drums, cleaners, and a second positioning plate, in the illustrative embodiment according to one or more aspects of the present disclosure.

As shown in FIGS. 6 to 8, the second positioning plate 29 is spaced apart leftward from the first positioning plate 28, and is disposed at a left end portion of the drum unit 9. The second positioning plate 29 is formed substantially in the same shape as the first positioning plate 28. As described above, the first positioning plate 28 includes the bulging section 45 provided at the inclined section 42. In contrast, the second positioning plate 29 does not include a bulging section 45 provided at an inclined section 42. Except for that difference, with respect to the other points, the second positioning plate 29 is configured in substantially the same manner as the first positioning plate 28. Therefore, a detailed explanation about the second positioning plate 29 will be omitted.

(2) Photoconductive Drum

As shown in FIG. 7, each photoconductive drum 11 includes a drum main body 50, a first flange 51, a second flange 52, and a drum coupling 53.

The drum main body 50 is disposed between the first positioning plate 28 and the second positioning plate 29 in the left-to-right direction. The drum main body 50 is a metal tube formed substantially in a cylindrical shape extending along the left-to-right direction. The drum main body 50 includes a photoconductive layer on an outer circumferential surface thereof.

The first flange 51 is non-rotatably fitted to a right end portion of the drum main body 50. The first flange 51 includes a large-diameter section 51A and a small-diameter section 51B.

The large-diameter section 51A is disposed at a left end portion of the first flange 51. The large-diameter section 51A is formed substantially in a cylindrical shape with a closed right end portion. An outer diameter of the large-diameter section 51A is substantially the same as an inner diameter of the drum main body 50. At the right end portion of the drum main body 50, the large-diameter section 51A is inserted into the drum main body 50.

The small-diameter section 51B protrudes rightward from a right wall of the large-diameter section 51A. The small-diameter section 51B is formed substantially in a cylindrical shape having a center axis in common with the large-diameter section 51A. The small-diameter section 51B has an outer diameter smaller than the outer diameter of the large-diameter section 51A. The small-diameter section 51B is fitted into the corresponding hole 40 of the first positioning plate 28.

Thereby, the first positioning plate 28 is configured to position the photoconductive drums 11 by supporting the respective first flanges 51 of the photoconductive drums 11.

The second flange 52 is non-rotatably fitted to a left end portion of the drum main body 50. The second flange 52 includes a large-diameter section 52A, a gear section 52C, and a small-diameter section 52B.

The large-diameter section 52A is disposed at a right end portion of the second flange 52. The large-diameter section 52A is formed substantially in a cylindrical shape. An outer diameter of the large-diameter section 52A is substantially the same as the inner diameter of the drum main body 50. At the left end portion of the drum main body 50, the large-diameter section 52A is inserted into the drum main body 50.

The gear section 52C is disposed adjacent to a left side of the large-diameter section 52A. The gear section 52C has a center axis in common with the large-diameter section 52A. The gear section 52C is formed substantially in a disk shape having a thickness in the left-to-right direction. The gear section 52C has gear teeth all over its circumferential surface.

The small-diameter section 52B protrudes leftward from the gear section 52C. The small-diameter section 52B is formed substantially in a cylindrical shape having a center axis in common with the large-diameter section 52A and the gear section 52C. The small-diameter section 52B has an outer diameter smaller than the outer diameters of the large-diameter section 52A and the gear section 52C. The small-diameter section 52B is fitted into the corresponding hole 40 of the second positioning plate 29.

Thus, the second positioning plate 29 is configured to position the photoconductive drums 11 by supporting the respective second flanges 52 of the photoconductive drums 11.

The drum coupling 53 is disposed at a left end portion of the corresponding photoconductive drum 11. The drum coupling 53 includes a disk section 53A and a shaft 53B.

The disk section 53A is disposed adjacent to the second positioning plate 29, on a left side relative to the second positioning plate 29. The disk section 53A is formed substantially in a disk shape having a thickness in the left-to-right direction. The disk section 53A has a diameter that is smaller than the diameter of the large-diameter section 52A of the second flange 52 and larger than the diameter of the small-diameter section 52B of the second flange 52.

The shaft 53B protrudes rightward from the disk section 53A. The shaft 53B is formed substantially in a cylindrical shape having a center axis in common with the disk section 53A. An outer diameter of the shaft 53B is substantially the same as an inner diameter of the small diameter section 52B. The shaft 53B is non-rotatably fitted into the small-diameter section 52B of the second flange 52.

(3) Cleaner

As shown in FIGS. 7 and 8, each cleaner 30 is disposed behind (i.e., on a rear side relative to) the corresponding photoconductive drum 11. Each cleaner 30 is configured to remove toner left adhering onto the surface of the photoconductive drum 11. Each cleaner 30 includes a frame 60, a cleaning member 61, a cleaning transportation member 62, and a discharging member 63.

The frame 60 includes a main body 66, a first wall 67, and a second wall 68.

The main body 66 is disposed at a rear end portion of the frame 60. The main body 66 is formed substantially in the shape of a rectangular tube that extends along the left-to-right direction and has closed end portions thereof in the left-to-right direction. The main body 66 includes a blade supporter 70, a waste toner transporter 71, a gear container 72, and a discharging member container 73.

As shown in FIG. 8, the blade supporter 70 is disposed at an upper end portion of the main body 66. The blade supporter 70 is formed substantially in a plate shape extending along the left-to-right direction.

The waste toner transporter 71 is disposed below the blade supporter 70. The waste toner transporter 71 is formed substantially in a semi-cylindrical shape that extends along the left-to-right direction and has a closed left end portion, an open right end portion, and a front end portion. An upper end portion of the waste toner transporter 71 is continuous with a lower end portion of the blade supporter 70.

As shown in FIG. 7, the gear container 72 is disposed on a left side relative to the waste toner transporter 71. The gear container 72 is formed substantially in a semi-cylindrical shape that extends along the left-to-right direction and has a closed left end portion, a closed right end portion, and an open front end portion.

As shown in FIG. 8, the discharging member container 73 is disposed below the waste toner transporter 71. The discharging member container 73 is formed substantially in the shape of a rectangular tube that extends along the left-to-right direction and has an open front end portion. An upper end portion of the discharging member container 73 is continuous with a lower end portion of the waste toner transporter 71.

As shown in FIG. 7, the first wall 67 is disposed at a right end portion of the frame 60. The first wall 67 is formed substantially in a flat plate shape extending frontward from a right end portion of the main body 66. The first wall 67 is in contact with an inner surface of the first positioning plate 28.

As shown in FIGS. 7 and 8, the second wall 68 is disposed at a left end portion of the frame 60. The second wall 68 is formed substantially in a flat plate shape extending frontward from a left end portion of the main body 66. The second wall 68 is in contact with an inner surface of the second positioning plate 29.

As shown in FIG. 8, the cleaning member 61 includes a supporter 75 and a blade 76.

The supporter 75 is made of metal. The supporter 75 is formed substantially in a flat plate shape extending along the left-to-right direction. The supporter 75 is fixedly attached to the blade supporter 70 of the frame 60.

The blade 76 is made of elastic material such as rubber. The blade 76 is formed substantially in a flat plate shape extending along the left-to-right direction. An upper end portion of the blade 76 is fixedly attached to the supporter 75. A lower end portion of the blade 76 faces a front side of the waste toner transporter 71. Further, a lower end portion of the blade 76 is curved rearward and in contact with a rear end portion of the drum main body 50 of the photoconductive drum 11.

As shown in FIGS. 7 and 8, the cleaning transportation member 62 is disposed inside the waste toner transporter 71. The cleaning transportation member 62 is an auger screw having the shape of a right-hand screw extending along the left-to-right direction. A left end portion of the cleaning transportation member 62 is rotatably supported by a wall between the gear container 72 and the waste toner transporter 71. Further, the left end portion of the cleaning transportation member 62 penetrates the wall between the gear container 72 and the waste toner transporter 71 and is positioned in the gear container 72. As shown in FIG. 7, the cleaning transportation member 62 includes a gear 78.

Inside the gear container 72, the gear 78 is non-rotatably supported by the left end portion of the cleaning transportation member 62. The gear 78 is formed substantially in a cylindrical shape extending along the left-to-right direction. The gear 78 has gear teeth all over its circumferential surface. The gear 78 is disposed behind (i.e., on a rear side relative to) the second flange 52 of the photoconductive drum 11. The gear 78 engages with the gear section 52C of the second flange 52 of the photoconductive drum 11.

As shown in FIG. 8, the discharging member 63 is fixedly attached inside the discharging member container 73. The discharging member 63 is formed substantially in a semi-cylindrical shape extending along the left-to-right direction. A front surface of the discharging member 63 is formed substantially in such an arc shape that a middle portion of the front surface in the vertical direction bulges frontward, in a side view (i.e., when viewed along the left-to-right direction). The discharging member 63 exposes toner remaining on the surface of the drum main body 50 of the photoconductive drum 11 after a toner image has been transferred onto a sheet P, before the toner is removed by the corresponding cleaning member 61. Thereby, electrical charges are reduced on the surface of the drum main body 50 of the corresponding photoconductive drum 11.

(4) Transporter

Figure 9:
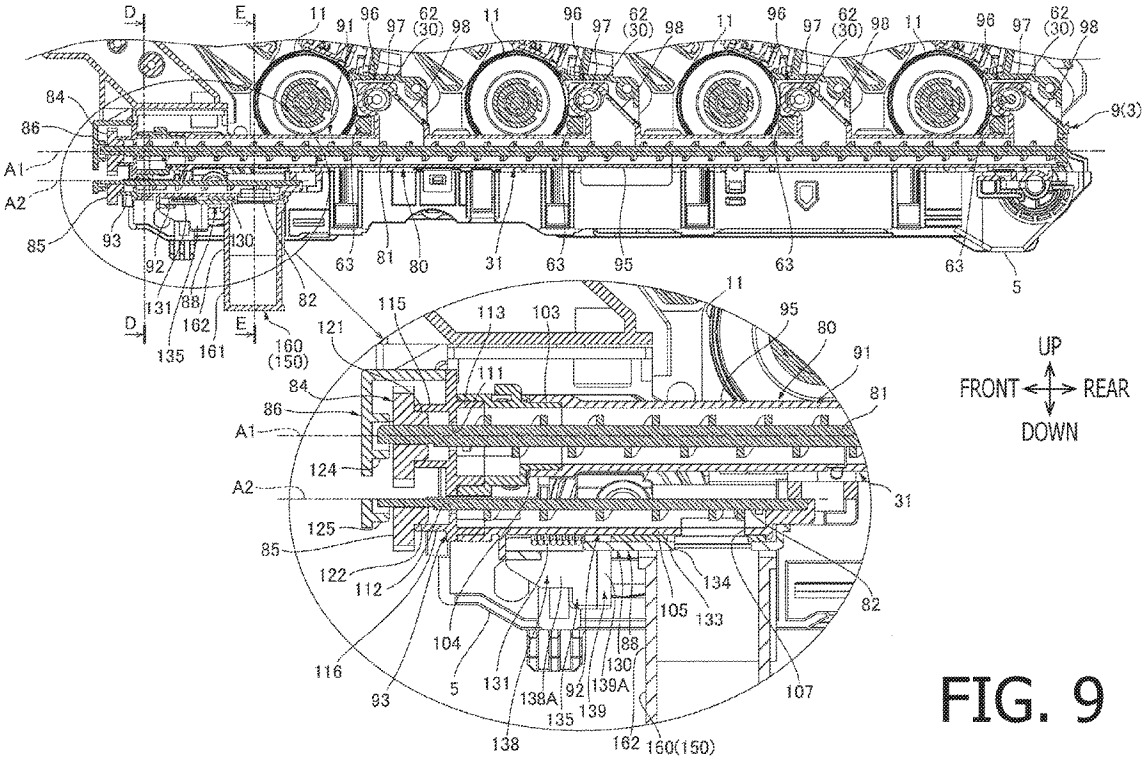
FIG. 9 is a cross-sectional view taken along line C-C shown in FIG. 6, in the illustrative embodiment according to one or more aspects of the present disclosure.

As shown in FIGS. 2 and 6, the transporter 31 is disposed at a lower right end portion of the drum unit 9. The transporter 31 is configured to transport the toner removed from the surfaces of the photoconductive drums 11 by the cleaners 30, to a below-mentioned waste toner container 150. As shown in FIGS. 4A and 9, the transporter 31 includes a transportation tube 80, a first transportation member 81, a second transportation member 82, a first gear 84, a second gear 85, a gear cover 86, and a shutter unit 88. The transportation tube 80 may be an example of a frame.

The transportation tube 80 extends along the front-to-rear direction, i.e., along the moving direction of the drum unit 9. The transportation tube 80 includes a first transportation section 91, a second transportation section 92, and a closed section 93. The closed section 93 has a hole 111 and a hole 112. The hole 111 is a hole through which the first transportation member 81 is inserted. The hole 112 is a hole through which the second transportation member 82 is inserted.

The first transportation section 91 includes a first transportation tube 95 and a plurality of joints (in the illustrative embodiment, four joints) 96.

Figure 10A:
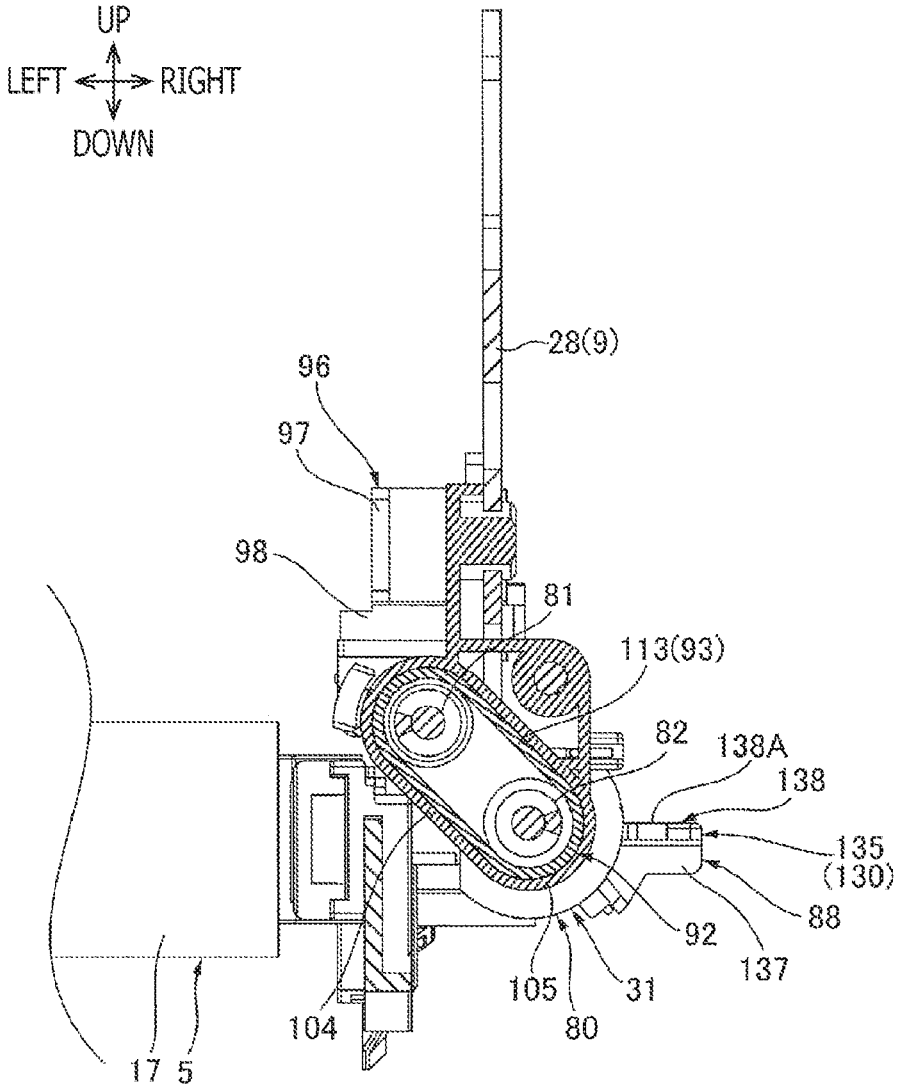
FIG. 10A is a cross-sectional view taken along line D-D shown in FIG. 9, in the state where the shutter is in the closed position, in the illustrative embodiment according to one or more aspects of the present disclosure.

The first transportation tube 95 is formed substantially in a cylindrical shape that extends along the front-to-rear direction and has a closed rear end portion. As shown in FIG. 10C, the first transportation tube 95 is disposed adjacent to the left side of a lower end portion of the first positioning plate 28.

Figure 4C:
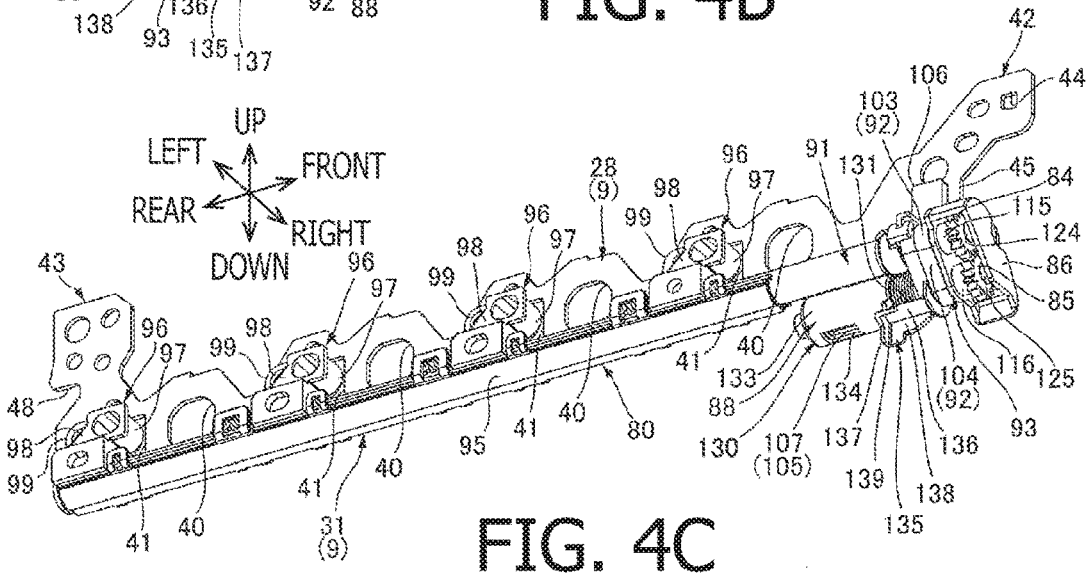
FIG. 4C is a perspective view, from a lower left side, of the transporter to which the first positioning plate is attached, in the illustrative embodiment according to one or more aspects of the present disclosure.

As shown in FIGS. 4A and 4C, the four joints 96 are arranged at intervals in the front-to-rear direction, above the first transportation tube 95. Each joint 96 includes an insertion section 97, a communication section 98, and a fixing section 99. The fixing section 99 has a fixing hole 101.

Each insertion section 97 is disposed at an upper front end portion of the corresponding joint 96. Each insertion section 97 is formed substantially in a cylindrical shape that extends along the left-to-right direction and has an open left end portion and a closed right end portion. Each insertion section 97 is connected with a right end portion of the frame 60 of the corresponding cleaner 30 via a seal member (not shown). A right end portion of the cleaning transportation member 62 of each cleaner 30 is inserted into the corresponding insertion section 97.

As shown in FIGS. 4C and 9, each communication section 98 is disposed on a lower rear side relative to the corresponding insertion section 97, behind the discharging member 63. Each communication section 98 is formed substantially in a rectangular tubular shape extending along the vertical direction. An upper rear end portion of each communication section 98 is inclined forward in an upward direction. An upper front end portion of each communication section 98 communicates with a lower rear end portion of the corresponding insertion section 97. A lower end portion of each communication section 98 communicates with an upper end portion of the first transportation tube 95.

As shown in FIGS. 4A and 4C, each fixing section 99 is disposed at an upper rear end portion of the corresponding joint 96. Each fixing section 99 is formed substantially in a rectangular flat plate shape extending upward from a right end portion of the corresponding communication section 98, in a side view.

Each fixing hole 101 is disposed at a central portion of the corresponding fixing section 99. Each fixing hole 101 penetrates the corresponding fixing section 99 in the left-to-right direction. Each fixing hole 101 is formed substantially in a round shape in a side view.

Although the following features are not shown in any drawings, each fixing section 99 is positioned between a right end portion of the frame 60 of the corresponding cleaner 30 and the first positioning plate 28, and a screw member is screwed into the fixing hole 101. Thereby, each fixing section 99 is fixedly attached to the frame 60 of the corresponding cleaner 30 and the first positioning plate 28.

Figure 10B:
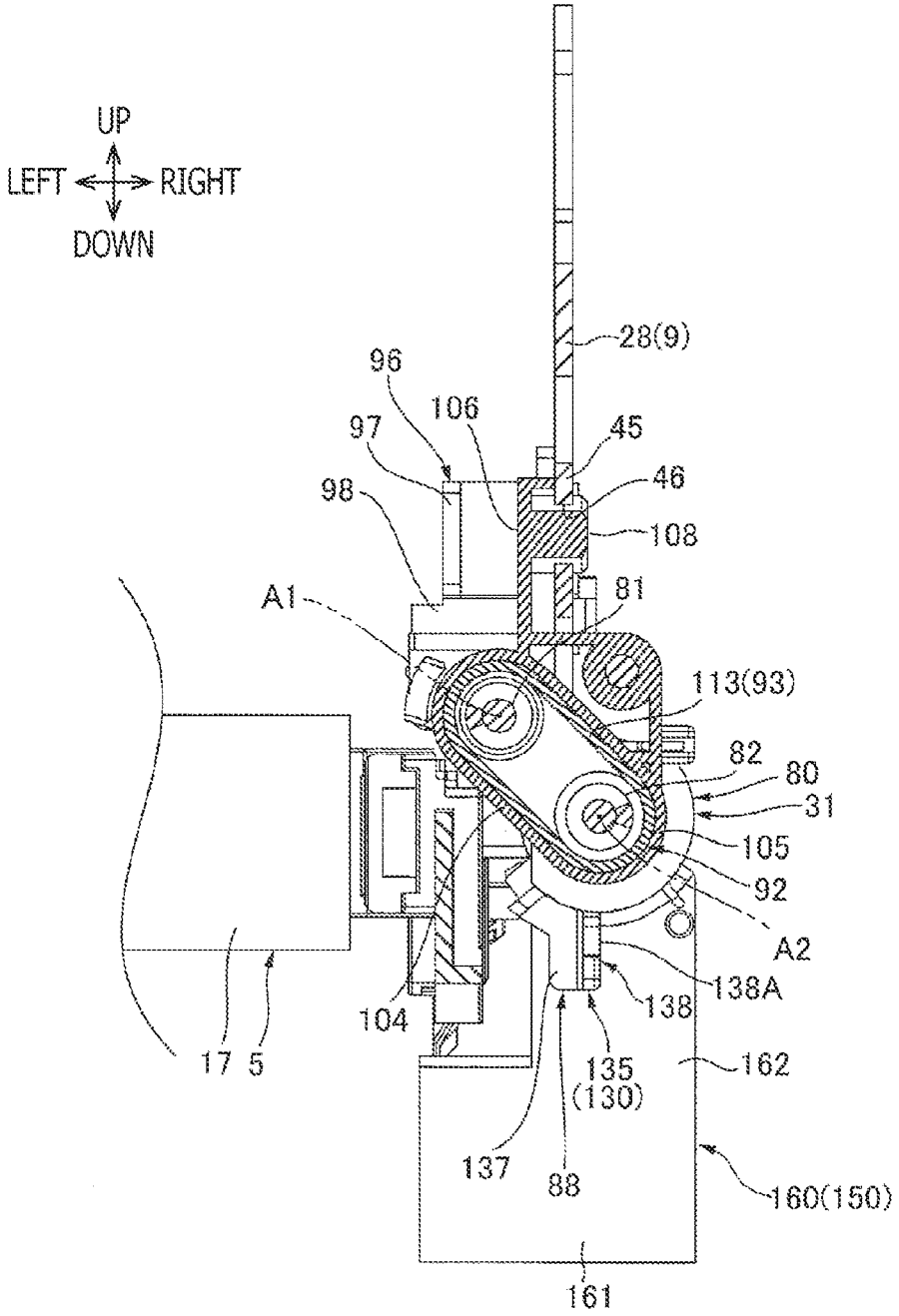
FIG. 10B is a cross-sectional view taken along line D-D shown in FIG. 9, in the state where the shutter is in the open position, in the illustrative embodiment according to one or more aspects of the present disclosure.
Figure 10C:
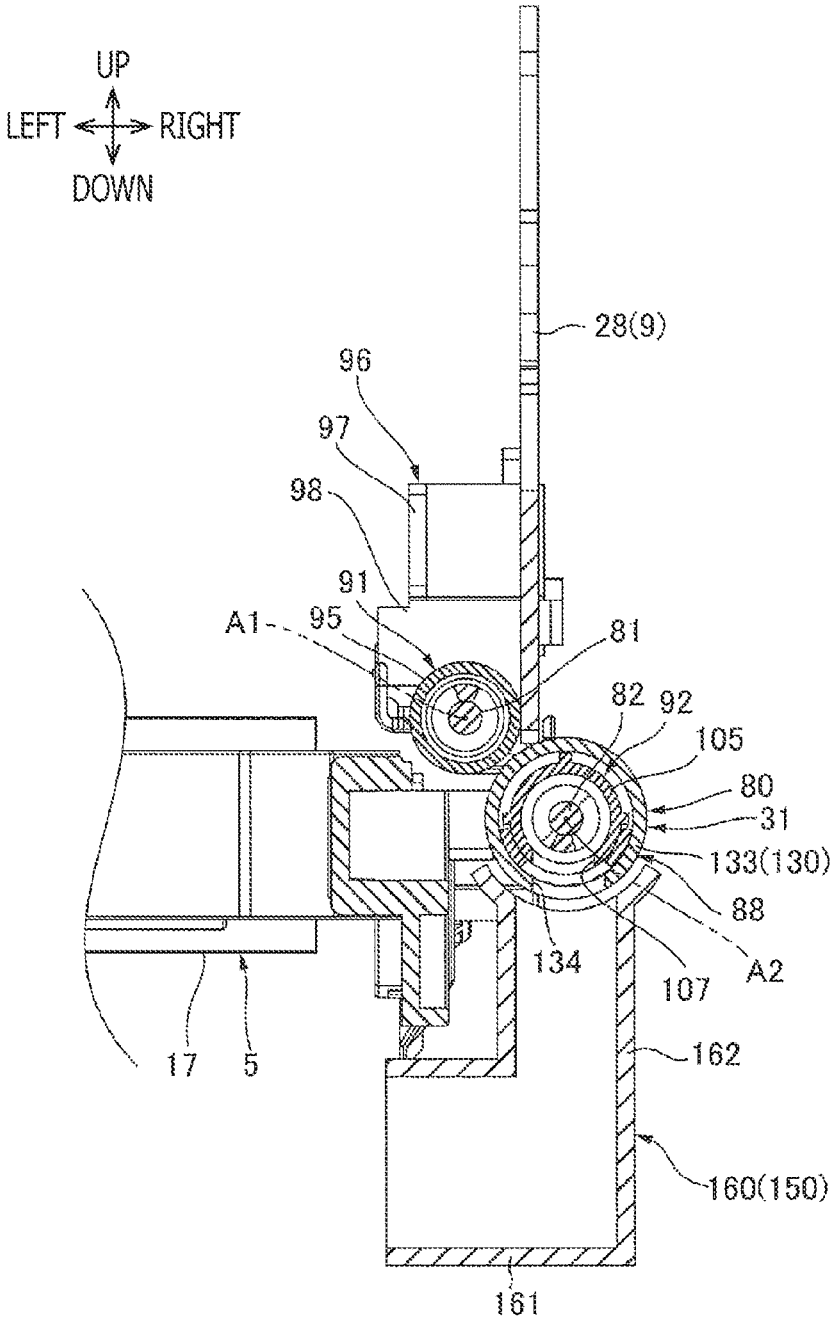
FIG. 10C is a cross-sectional view taken along line E-E shown in FIG. 9, in the state where the shutter is in the open position, in the illustrative embodiment according to one or more aspects of the present disclosure.

As shown in FIGS. 9 and 10B, the second transportation section 92 includes a connecting tube 103, a second transportation tube 104, a third transportation tube 105, and an engagement section 106. The third transportation tube 105 has an outlet 107. The outlet 107 is an example of an opening.

The connecting tube 103 is disposed at an upper left end portion of the second transportation section 92. The connecting tube 103 is formed substantially in a cylindrical shape extending along the front-to-rear direction and having a center axis in common with the first transportation tube 95. The connecting tube 103 is fitted into a front end portion of the first transportation tube 95.

As shown in FIGS. 4C and 10B, the second transportation tube 104 is disposed on a lower right side relative to a front end portion of the connecting tube 103. The second transportation tube 104 is formed substantially in a rectangular tubular shape extending along a direction from an upper left side to a lower right side and having an open front side. Namely, the second transportation tube 104 extends in a direction intersecting the extending direction (e.g., the front-to-rear direction) of the first transportation tube 95. An upper left end portion of the second transportation tube 104 communicates with a lower right end part of a front end portion of the connecting tube 103. Namely, the second transportation tube 104 is connected with the front end portion of the first transportation tube 95 via the connecting tube 103.

Figure 5B:
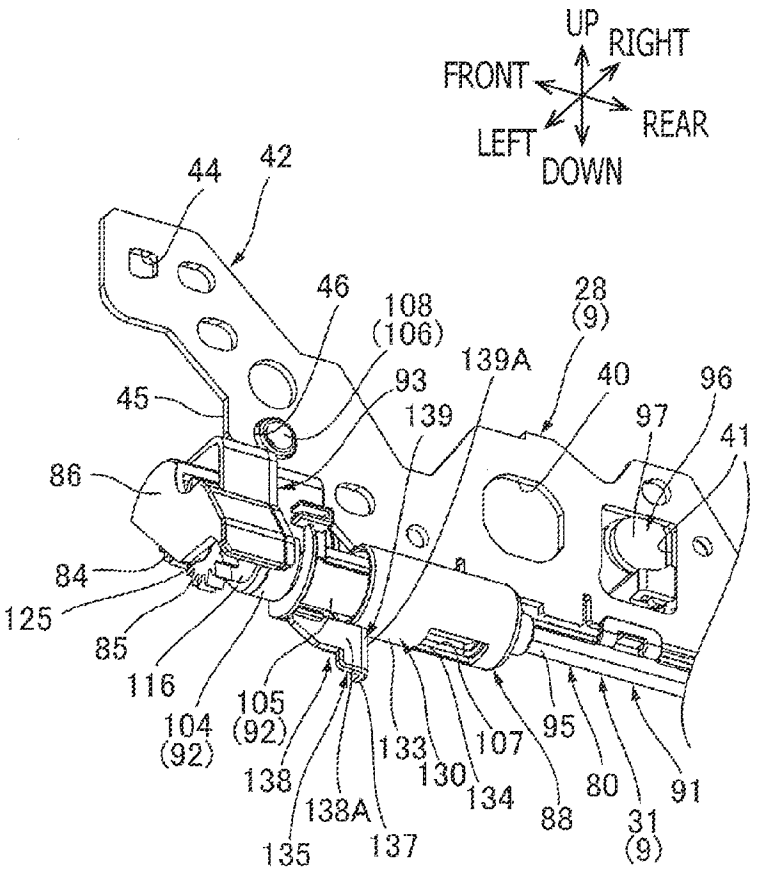
FIG. 5B is a perspective view, from the lower right side, of the transporter to which the first positioning plate is attached, in a state where the shutter is in an open position, and the urging member is not shown for the sake of illustrative convenience, in the illustrative embodiment according to one or more aspects of the present disclosure.
Figure 5A:
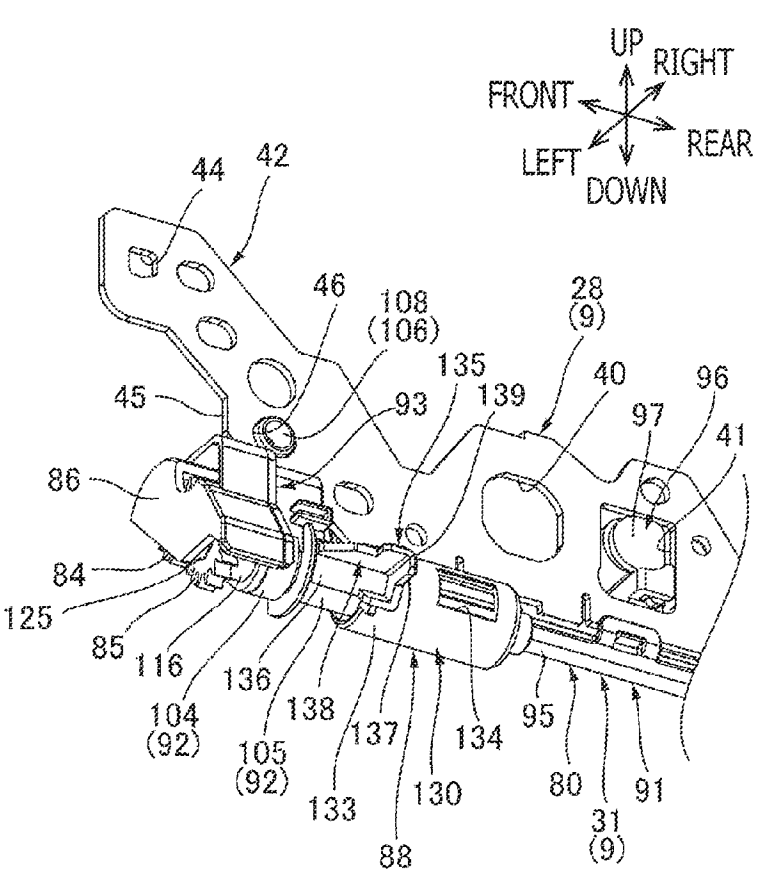
FIG. 5A is a perspective view, from a lower right side, of the transporter to which the first positioning plate is attached, in a state where a shutter is in a closed position, and an urging member is not shown for the sake of illustrative convenience, in the illustrative embodiment according to one or more aspects of the present disclosure.

As shown in FIGS. 5A and 9, the third transportation tube 105 is formed substantially in a cylindrical shape extending rearward from a lower right end portion of the second transportation tube 104 and having a closed rear end portion. The third transportation tube 105 extends along the same direction as the extending direction of the first transportation tube 95. The third transportation tube 105 is communicably connected with the first transportation tube 95 via the second transportation tube 104. In other words, the second transportation tube 104 connects the first transportation tube 95 with the third transportation tube 105 in such a manner that an internal space of the first transportation tube 95 communicates with an internal space of the third transportation tube 105 via the second transportation tube 104. As shown in FIG. 10C, the third transportation tube 105 is disposed below the first positioning plate 28. As shown in FIG. 9, a rear end portion of the third transportation tube 105 is positioned in front of a center axis of the forefront photoconductive drum 11 and the forefront joint 96.

The outlet 107 is positioned at a rear end portion of the third transportation tube 105. The outlet 107 penetrates a lower circumferential wall of the third transportation tube 105. The outlet 107 is formed substantially in a rectangular shape in a bottom view (i.e., when viewed from the bottom). The outlet 107 is positioned in front of a center axis of the forefront photoconductive drum 11. As shown in FIG. 10C, the outlet 107 overlaps the first positioning plate 28 when viewed in the vertical direction. In other words, the outlet 107 is positionally coincident with at least a part of the first positioning plate 28 in the front-to-rear direction and the left-to-right direction.

As shown in FIGS. 4A and 10B, the engagement section 106 is formed substantially in a rectangular flat plate shape protruding upward from an upper portion of the connecting tube 103, in a side view. The engagement section 106 is disposed on a left side relative to the bulging section 45 of the first positioning plate 28. The engagement section 106 includes a boss 108.

The boss 108 is formed substantially in a cylindrical shape protruding rightward from a right surface of the engagement section 106. The boss 108 is fitted into the hole 46 of the first positioning plate 28.

As shown in FIGS. 4C and 9, the closed section 93 is disposed at a front end portion of the transportation tube 80. The closed section 93 is formed substantially in a rectangular flat plate shape extending along a direction from an upper left side to a lower right side, in a front view (i.e., when viewed from the front). The closed section 93 includes an insertion section 113, a supporter 115 configured to support the first gear 84, and a supporter configured to support the second gear 85.

The hole 111 is positioned substantially at a central part of an upper left portion of the closed section 93. The hole 111 is formed substantially in a round shape in a front view. The hole 111 has a center axis in common with the first transportation member 81.

The hole 112 is positioned substantially at a central part of a lower right portion of the closed section 93. The hole 112 is formed substantially in a round shape in a front view. The hole 112 has a center axis in common with the second transportation member 82.

As shown in FIG. 9, the insertion section 113 extends rearward from a rear surface of the closed section 93. As shown in FIG. 10B, the insertion section 113 is formed substantially in an oval cylindrical shape in a cross-sectional front view. The insertion section 113 is fitted into a front end portion of the second transportation section 92.

As shown in FIG. 9, the supporter 115 is formed substantially in a cylindrical shape extending frontward from a front surface portion of the closed section 93 that is slightly spaced apart from a circumferential edge of the hole 111. The supporter 115 has a center axis in common with the hole 111.

The supporter 116 is formed substantially in a cylindrical shape extending frontward from a front surface portion of the closed section 93 that is slightly spaced apart from a circumferential edge of the hole 112. The supporter 116 has a center axis in common with the hole 112.

The first transportation member 81 is disposed inside the first transportation tube 95 of the first transporter 91. The first transportation member 81 is an auger screw formed in the shape of a right-hand screw that is rotatable around a first axis A1 extending along the front-to-rear direction. A rear end portion of the first transportation member 81 is rotatably supported by a rear wall of the first transportation tube 95. A front end portion of the first transportation member 81 passes through the hole 111 of the closed section 93 and extends up to a position ahead of a front end portion of the supporter 115 of the closed section 93.

The second transportation member 82 is disposed inside the third transportation tube 105 of the second transporter 92. The second transportation member 82 is an auger screw formed in the shape of a right-hand screw that is rotatable around a second axis A1 extending along the front-to-rear direction. The second transportation member 82 is disposed on a lower right side relative to the first transportation member 81. In other words, the first axis A1 of the first transportation member 82 is positioned above the second axis A2 of the second transportation member 82. Further, the second transportation member 82 is parallel to the first transportation member 81. A dimension of the second transportation member 82 in the front-to-rear direction is smaller than a dimension of the first transportation member 81 in the front-to-rear direction. A rear end portion of the second transportation member 82 is rotatably supported by a rear wall of the third transportation tube 105. A front end portion of the second transportation member 82 passes through the hole 112 of the closed section 93 and extends up to a position ahead of a front end portion of the supporter 116 of the closed section 93.

The first gear 84 is non-rotatably supported by the front end portion of the first transportation member 81, in front of the closed section 93. The first gear 84 is formed substantially in a cylindrical shape extending along the front-to-rear direction. The first gear 84 has gear teeth all over its outer circumferential surface. Namely, the first gear 84 is fixedly attached to the first transportation member 81 and rotatable along with the first transportation member 81. Further, the first gear 84 includes a first boss 121.

The first boss 121 is formed substantially in a cylindrical shape that protrudes rearward from a rear surface of the first gear 84 and has a center axis in common with the first gear 84. The first boss 121 is rotatably fitted into the supporter 115 of the closed section 93.

The second gear 85 is non-rotatably supported by the front end portion of the second transportation member 82, in front of the closed section 93. The second gear 85 is formed substantially in a cylindrical shape extending along the front-to-rear direction. The second gear 85 has gear teeth all over its outer circumferential surface. Namely, the second gear 85 is fixedly attached to the second transportation member 82 and rotatable along with the second transportation member 82. The second gear 85 engages with a lower right end portion of the first gear 84.

The second boss 122 is formed substantially in a cylindrical shape that protrudes rearward from a rear surface of the second gear 85 and has a center axis in common with the second gear 85. The second boss 122 is rotatably fitted into the supporter 116 of the closed section 93.

As shown in FIGS. 4C and 9, the gear cover 86 is disposed at a front end portion of the transporter 31. The gear cover 86 is formed substantially in a box shape having an open rear side and an open lower left side. The gear cover 86 covers the first gear 84 and the second gear 85 from the front such that a lower left end portion of the first gear 84 and a lower left end portion of the second gear 85 are exposed. Further, the gear cover 86 includes a supporter 124 configured to support the first transportation member 81, and a supporter 125 configured to support the second transportation member 82.

The supporter 124 is formed substantially in a cylindrical shape protruding rearward from a rear surface of a front wall of the gear cover 86. The supporter 124 has a center axis in common with the first transportation member 81. The supporter 124 is configured to accept a front end portion of the first transportation member 81 to be rotatable relative to the supporter 124.

The supporter 125 is formed substantially in a cylindrical shape protruding rearward from a rear surface of the gear cover 86, on a lower right side relative to the supporter 124. The supporter 125 has a center axis in common with the second transportation member 82. The supporter 125 is configured to accept a front end portion of the second transportation member 82 to be rotatable relative to the supporter 125.

As shown in FIG. 2, the shutter unit 88 is assembled with the third transportation tube 105 of the second transportation section 92. The shutter unit 88 includes a shutter 130 and an urging member 131.

The shutter 130 is rotatable between a closed position (see FIG. 5A) to close the outlet 107 of the third transportation tube 105 and an open position (see FIG. 5B) to open the outlet 107. The following description regarding the shutter 130 will be provided based on a state where the shutter 130 is in the closed position shown in FIG. 5A.

As shown in FIGS. 4A and 5A, the shutter 130 includes a shutter main body 133 and a protruding section 135. The shutter main body 133 has a communication port 134.

The shutter main body 133 is formed substantially in a cylindrical shape extending along the front-to-rear direction. The shutter main body 133 is configured to accept therein the third transportation tube 105.

The communication port 134 penetrates a right circumferential wall of the shutter main body 133 in the left-to-right direction. The communication port 134 is formed substantially in a rectangular shape in a side view. The communication port 134 is substantially in the same position as the outlet 107 of the third transportation tube 105 in the front-to-rear direction.

The protruding section 135 is disposed at a front end portion of the shutter 130. As shown in FIG. 9, the protruding section 135 is positioned in front of the forefront photoconductive drum 11 and the outlet 107. In other words, the protruding section 135 is positioned upstream of the forefront photoconductive drum 11 and the outlet 107 in a moving direction of the drum unit 9 from the outside position toward the inside position. The protruding section 135 is formed integrally with the shutter main body 133. The protruding section 135 protrudes outward in a radial direction of the shutter main body 133, and is L-shaped. The protruding section 135 includes a first plate 136, a second plate 137, and a third plate 138. The third plate 138 is an example of a first section. The second plate 137 is an example of a second section.

The first plate 136 is formed substantially in a flat plate shape extending frontward from a front right end portion of the shutter main body 133. The first plate 136 is curved along a circumferential surface of the third transportation tube 105. A curvature radius of the first plate 136 is substantially the same as a radius of the shutter main body 133.

The second plate 137 extends rightward from the front right end portion of the shutter main body 133. The protruding section 135 is formed substantially in a flat plate shape in a front view.

The third plate 138 is formed substantially in a rectangular flat plate shape connecting an upper end portion of the first plate 136 with an upper end portion of the second plate 137, in a plane view (i.e., when viewed from the top). Namely, the third plate 138 extends frontward from the upper end portion of the second plate 137. Further, in other words, the second plate 137 extends downward from a rear end portion of the third plate 138. An upper surface of the third plate 138 is configured as a pressed surface 138A. The pressed surface 138A is an example of a second surface. The pressed surface 138A is a flat surface.

In the protruding section 135, a continuous joint portion between the second plate 137 and the third plate 138 is configured as a curved section 139.

The curved section 139 becomes more curved toward the third plate 138 from the second plate 137. The curved section 139 bulges rearward. A circumferential surface of the curved section 139 is configured as a curved surface 139A. The curved surface 139 is an example of a fourth surface.

When the shutter 130 is in the open position shown in FIGS. 5B and 10B, the protruding section 135 is in a first position where the protruding section 135 extends downward from the shutter main body 133. When the shutter 130 is in the closed position shown in FIGS. 5A and 10A, the protruding section 135 is in a second position where the protruding section 135 extends rightward from the shutter main body 133. As shown in FIG. 10A, when the shutter 130 is in the closed position, the protruding section 135 is positioned on a right side relative to the first positioning plate 28. Further, the protruding section 135 is formed integrally with the shutter main body 133. Thereby, as shown in FIGS. 5A and 5B, a moving distance of the shutter 130 from the closed position to the open position is substantially the same as a moving distance of the protruding section 135 from the second position to the first position.

As shown in FIGS. 4A and 9, the urging member 131 includes a coil spring formed by spirally winding a wire along the front-to-rear direction. The urging member 131 is configured to accept therein a front end portion of the third transportation tube 105. The urging member 131 overlaps the protruding section 135 of the shutter 130 in the front-to-rear direction. In other words, the urging member 131 is positionally coincident with at least a part of the protruding section 135 in the front-to-rear direction. Although the following features are not shown in any drawings, an end portion of the wire of the urging member 131 is fixedly attached to the third transportation tube 105, and the other end portion is fixedly attached to the protruding section 135. Thus, the urging member 131 is configured to urge the shutter 130 counterclockwise in a front view, so as to place the protruding section 135 in the second position and place the shutter 130 in the closed position.

(5) Front Plate, Rear Plate, First Side Plate, Second Side Plate, and Unit Reference Axis As shown in FIGS. 2 and 6, the front plate 32 is disposed at a front end portion of the drum unit 9. The front plate 32 is formed substantially in a rectangular flat plate shape extending along the left-to-right direction as a longitudinal direction thereof, in a front view. The front plate 32 is laid between a front end portion of the first positioning plate 28 and a front end portion of the second positioning plate 29. The front plate 32 includes a front handle 32A.

The front handle 32A is disposed substantially at a central portion of the front plate 32 in the left-to-right direction. The handle 32A protrudes frontward from a front surface of the front plate 32. The handle 32A is formed substantially in a flat plate shape extending along the left-to-right direction.

The rear plate 33 is disposed at a rear end portion of the drum unit 9. The rear plate 33 is formed substantially in a rectangular flat plate shape extending along the left-to-right direction as a longitudinal direction thereof, in a front view. The rear plate 33 is laid between a rear end portion of the first positioning plate 28 and a rear end portion of the second positioning plate 29. The rear plate 33 includes a rear handle 33A.

The rear handle 33A is disposed at an upper end portion of the rear plate 33. The rear handle 33A protrudes upward from an upper surface of the rear plate 33, and extends along the left-to-right direction. The rear handle 33A is formed substantially in a rectangular frame shape in a rear view (i.e., when viewed from the rear).

As shown in FIGS. 2 and 7, the first side plate 34 is disposed on a right side relative to the first positioning plate 28. The first side plate 34 is formed substantially in a rectangular flat plate shape wider than the first positioning plate 28 in the vertical direction, in a side view.

Figure 3:
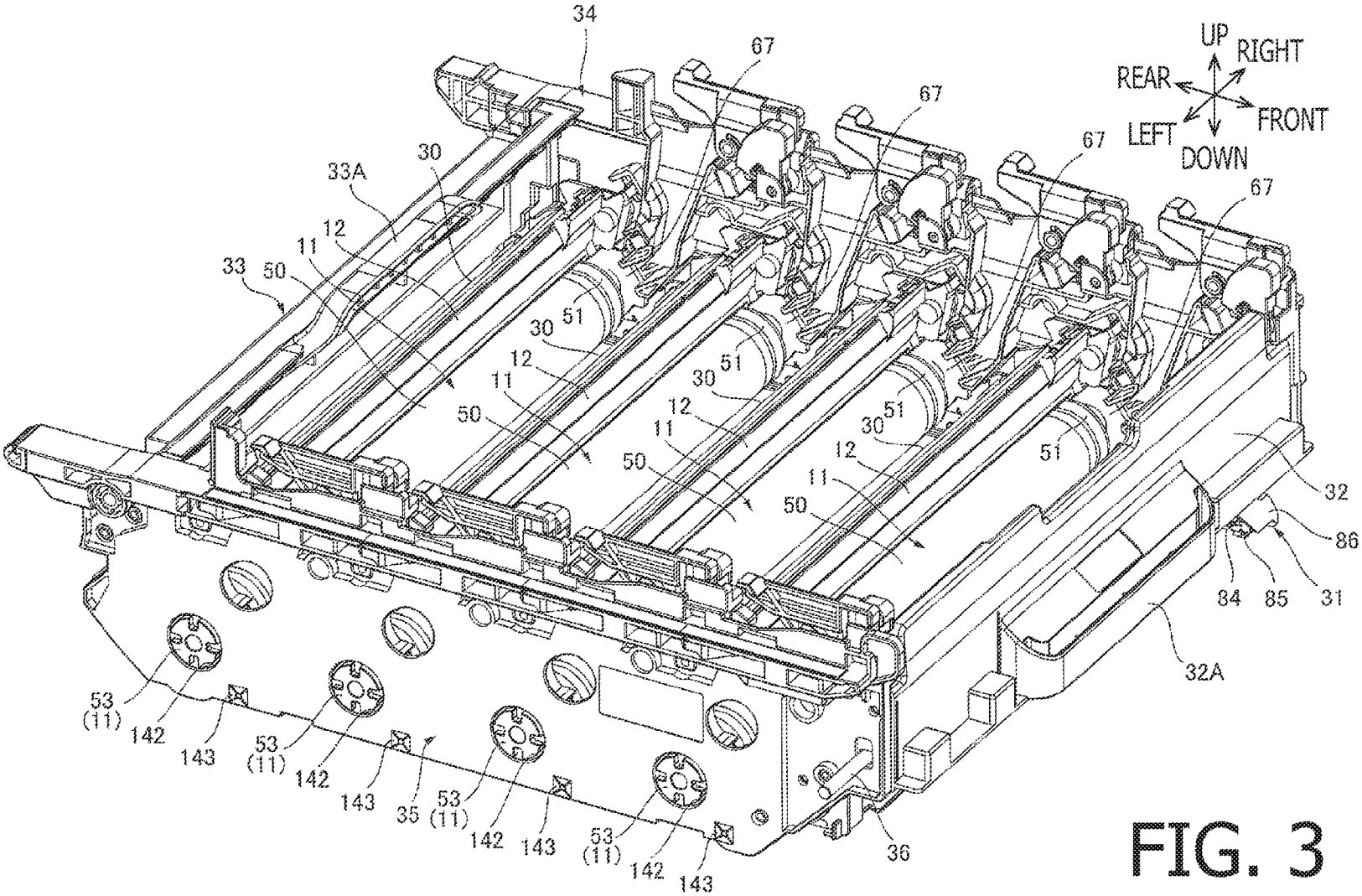
FIG. 3 is a perspective view, from an upper left side, of the drum unit in the illustrative embodiment according to one or more aspects of the present disclosure.

As shown in FIGS. 3 and 6, the second side plate 35 is disposed on a left side relative to the second positioning plate 29. The second side plate 35 is formed substantially in a rectangular flat plate shape wider than the second positioning plate 29 in the vertical direction, in a side view. The second side plate 35 includes a plurality of positioned sections (in the illustrative embodiment, four positioned sections) 143.

As shown in FIGS. 3 and 7, the four holes 142 are arranged at intervals in the front-to-rear direction. Each hole 142 is disposed to be positionally coincident with the corresponding photoconductive drum 11. Each hole 142 is formed substantially in a round shape in a side view. Each hole 142 is configured to accept the drum coupling 53 of the corresponding photoconductive drum 11.

As shown in FIGS. 3 and 6, the four positioned sections 143 are arranged at intervals in the front-to-rear direction. Each positioned section 143 is positioned on a lower front side relative to the corresponding hole 142. Each positioned section 143 protrudes rightward from a left surface of the second side plate 35. Each positioned section 143 is formed substantially in the shape of a truncated square pyramid that is tapered leftward.

As shown in FIGS. 2 and 3, the unit reference shaft 36 is disposed at a front end portion of the drum unit 9. The unit reference shaft 36 is made of metal. The unit reference shaft 36 is formed substantially in a cylindrical shape extending along the left-to-right direction. As shown in FIGS. 6 and 12B, the unit reference shaft 36 is inserted through the hole 44 of the first positioning plate 28 and the hole 44 of the second positioning plate 29. A right end portion of the unit reference shaft 36 protrudes rightward relative to the first side plate 34. A left end portion of the unit reference shaft 36 protrudes leftward relative to the second side plate 35.

3. Configuration of Main Body Casing

As shown in FIGS. 1 and 12B, the main body casing 2 includes a waste toner container 150, main body reference plates 153, a main body reference shaft 154, main body couplings 155 (see FIG. 7), a positioning section 157 (see FIG. 6), and a contact section 171 (see FIG. 6).

As shown in FIG. 1, the waste toner container 150 is disposed below the belt unit 5. The waste toner container 150 is formed substantially in a box shape. The waste toner container 150 is configured to store therein toner removed by the cleaner 30. As shown in FIGS. 9 and 10C, the waste toner container 150 includes an introduction tube 160.

The introduction tube 160 is disposed at a right end portion of a front end portion of the waste toner container 150. The introduction tube 160 includes a first section 161 and a second section 162.

As shown in FIGS. 10B and 10C, the first section 161 is formed substantially in a rectangular tubular shape extending along the left-to-right direction. Although the following features are not shown in any drawings, a left end portion of the first section 161 communicates with an internal space of the waste toner container 150.

As shown in FIGS. 9 and 10C, the second section 162 is disposed on a right side relative to the front end portion of the belt unit 5. The second section 162 is formed substantially in a rectangular tubular shape extending along the vertical direction. A lower end portion of the second section 162 communicates with the first section 161.

As shown in FIG. 12B, the main body reference plates 153 are disposed in a front end portion of the main body casing 2. In the illustrative embodiment, there are two main body reference plates 153 spaced apart from each other in the left-to-right direction. Each main body reference plate 153 includes a placement section 153A and an erected section 153B.

The placement section 153A is disposed at a lower end portion of the main body reference plate 153. The placement section 153A is formed substantially in a square pole shape extending along the front-to-rear direction.

The erected section 153B is formed substantially in a square pole shape extending upward from a rear end portion of the placement section 153A.

As shown in FIGS. 1 and 12B, the main body reference shaft 154 is disposed in a rear end portion of the main body casing 2. The main body reference shaft 154 is made of metal. The main body reference shaft 154 is formed substantially in a cylindrical shape extending along the left-to-right direction.

As shown in FIG. 7, the four main body couplings 155 are arranged at intervals in the front-to-rear direction, at a left end portion of the main body casing 2. Each main body coupling 155 is disposed on a left side relative to the corresponding photoconductive drum 11. In a state where the process unit 3 is attached to the main body casing 2, a left end portion of each main body coupling 155 is fitted into the drum coupling 53 of the corresponding photoconductive drum 11. The main body couplings 155 are configured to move along the left-to-right direction in conjunction with opening and closing operations of the front cover 22 by a known interlocking mechanism. Further, each main body coupling 155 is configured to rotate by a driving force transmitted from a driving source such as a motor (not shown) provided in the main body casing 2.

As shown in FIG. 6, the positioning section 157 is disposed at a lower left portion inside the main body casing 2. The positioning section 157 is formed substantially in a square pole shape extending along the front-to-rear direction.

Figure 11B:
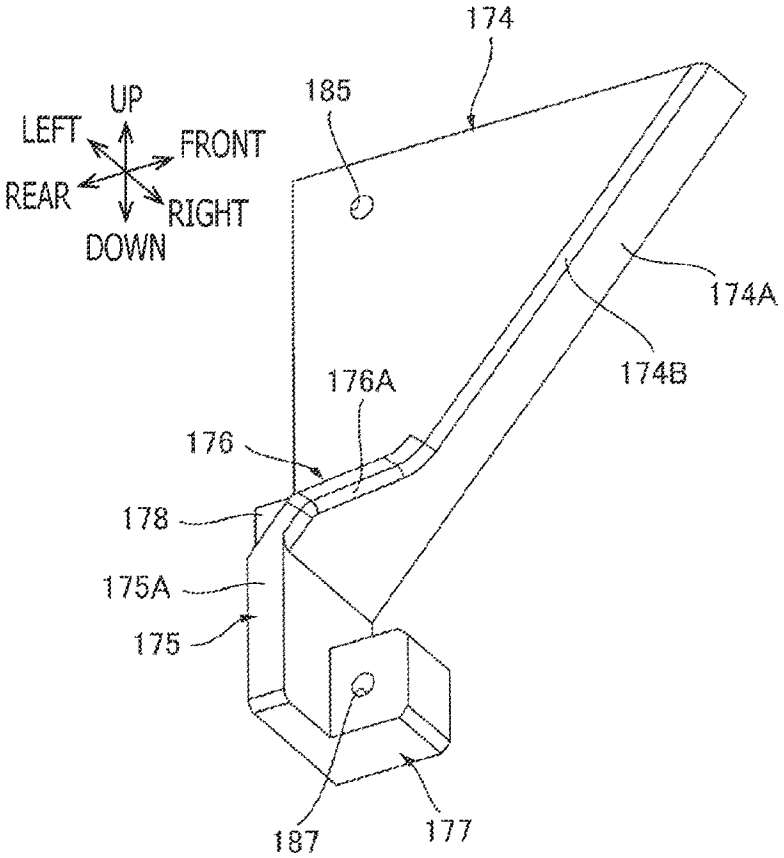
FIG. 11B is a perspective view, from a lower left side, of the contact section in the illustrative embodiment according to one or more aspects of the present disclosure.
Figure 11A:
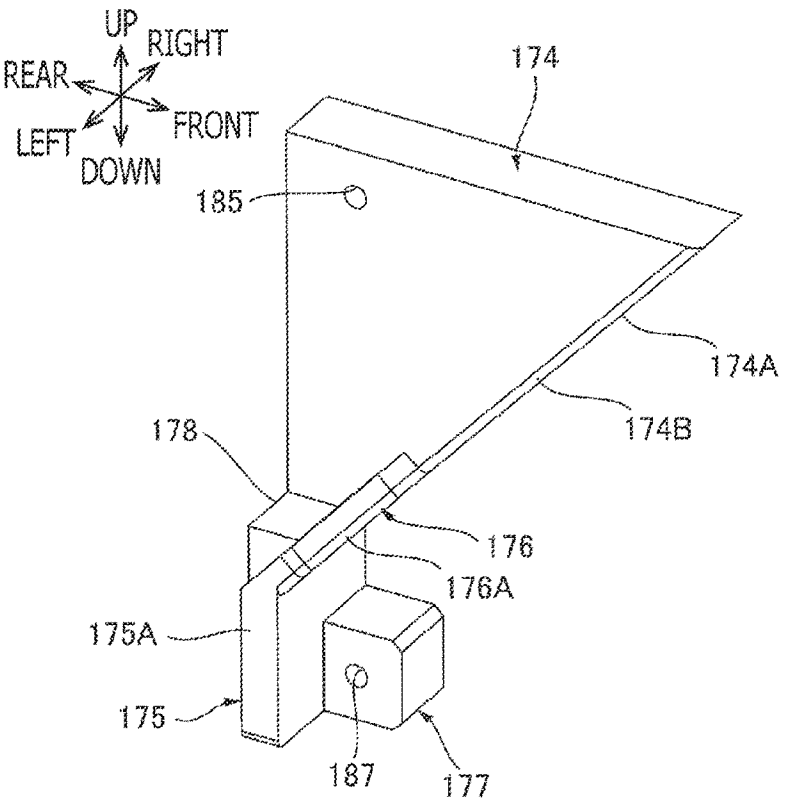
FIG. 11A is a perspective view, from an upper left side, of a contact section in the illustrative embodiment according to one or more aspects of the present disclosure.

As shown in FIGS. 6 and 12B, inside the main body casing 2, the contact section 171 is disposed below the main body reference plates 153 and ahead of the introduction tube 160 of the waste toner container 150. As shown in FIGS. 11A and 11B, the contact section 171 includes an inclined plate 174, a pressing plate 175, a connecting plate 176, a protrusion 177, and a reinforcing section 178. The inclined plate 174 has a hole 185. The protrusion 177 has a hole 187.

The inclined plate 174 is formed substantially in a triangular flat plate shape in a side view. The inclined plate 174 has a front surface inclined downward in a rearward direction. The front surface of the inclined plate 174 is configured as an inclined surface 174A. The inclined surface 174A is an example of a third surface. The inclined surface 174A faces frontward. A dimension of the inclined surface 174A in the vertical direction is larger than a moving distance of the drum unit 9 in the vertical direction between the first inside position and the second inside position. A left edge portion of the inclined surface 174A is chamfered. The chamfered portion of the inclined plate 174 is configured as a first sliding surface 174B. The first sliding surface 174B is an example of a fifth surface. Namely, the first sliding surface 174B is continuous with the inclined surface 174A. Further, the first sliding surface 174B is inclined downward in a rearward direction.

The hole 185 is positioned at an upper front end portion of the inclined plate 174. The hole 185 is formed substantially in a round shape in a side view.

The pressing plate 175 is disposed at a lower end portion of the contact section 171. The pressing plate 175 is formed substantially in a rectangular flat plate shape protruding downward from a lower end portion of the inclined plate 174, in a front view. A right surface of the pressing plate 174 is flush with a right surface of the inclined plate 174. A left surface of the pressing plate 175 is positioned on a right side relative to a left surface of the inclined plate 174. The left surface of the pressing plate 175 is configured as a pressing surface 175A. The pressing surface 175A is an example of a first surface. Namely, the pressing surface 175A faces leftward. The pressing surface 175A is a flat surface.

The connecting plate 176 connects a lower end portion of the inclined plate 174 with an upper end portion of the pressing plate 175. The connecting plate 176 is formed substantially in a triangular flat plate shape when viewed from a lower front side. The connecting plate 176 is inclined along the inclined surface 174A of the inclined plate 174. Namely, a lower front surface of the connecting plate 176 is flush with the inclined surface 174A. An upper front surface of the connecting plate 176 is inclined downward in a leftward direction. The upper front surface of the connecting plate 176 is configured as a second sliding surface 176A. The second sliding surface 176A is an example of a sixth surface. The second sliding surface 176A is inclined downward in a rearward direction. The second sliding surface 176A is continuous with both of the first sliding surface 174B and the pressing surface 175A.

The second sliding surface 176A of the connecting plate 176 and the first sliding surface 174B of the inclined plate 174 are together configured as an example of a guide surface.

The protrusion 177 is disposed at a lower right end portion of the pressing plate 175. The protrusion 177 is formed substantially in a square pole shape protruding frontward from the lower right end portion of the pressing plate 175.

The hole 187 is positioned substantially at a central portion of the protrusion 177 in a side view. The hole 187 is formed substantially in a round shape in a side view.

The reinforcing section 178 connects a lower end portion of the inclined plate 174, a lower end portion of the connecting plate 176, and an upper end portion of the pressing plate 175. The reinforcing section 178 is formed substantially in a triangular prism shape in a side view.

Although the following features are not shown in any drawings, the contact section 171 is attached to the main body casing 2 by screws being screwed through the hole 185 and the hole 187. Thereby, the contact section 171 is positioned relative to the min body casing 2, and fixedly attached to the main body casing 2.

4. Operations of Attaching and Detaching Drum Unit

To attach the drum unit 9 into the main body casing 2, as shown in FIG. 1, an operator first opens the opening 21 by swinging the front cover 22 of the main body casing 2 with the lower end portion of the front cover 22 as a fulcrum.

Subsequently, as shown in FIGS. 1 and 2, the operator holds the front handle 32A and the rear handle 33A of the drum unit 9 and places the drum unit 9 into the outside position. Then, the operator pushes the drum unit 9 rearward via the opening 21.

Thereby, as shown in FIGS. 12A and 12B, the drum unit 9 moves rearward inside the main body casing 2, and is placed in the first inside position within the inside position.

At this time, the drum unit 9 is positioned on an upper front side relative to the belt unit 5.

Further, when projected in the front-to-rear direction, the curved surface 139A of the protruding section 135 overlaps the inclined surface 174A of the contact section 171.

Subsequently, as shown in FIGS. 12C and 12D, the operator further pushes the drum unit 9 into the main body casing 2.

Thereby, in the drum unit 9, firstly, the curved surface 139A of the protruding section 135 causes interference with (e.g., comes into contact with) the inclined surface 174A of the contact section 171.

The inclined surface 174A is inclined downward in the rearward direction. Therefore, when the drum unit 9 moves rearward, the protruding section 135 is pushed downward, and the shutter 130 begins to rotate clockwise in a front view.

Then, the curved surface 139A of the protruding section 135 is separated away from the inclined surface 174A of the contact section 171, and brought into contact with the first sliding surface 174B.

Figure 13B:
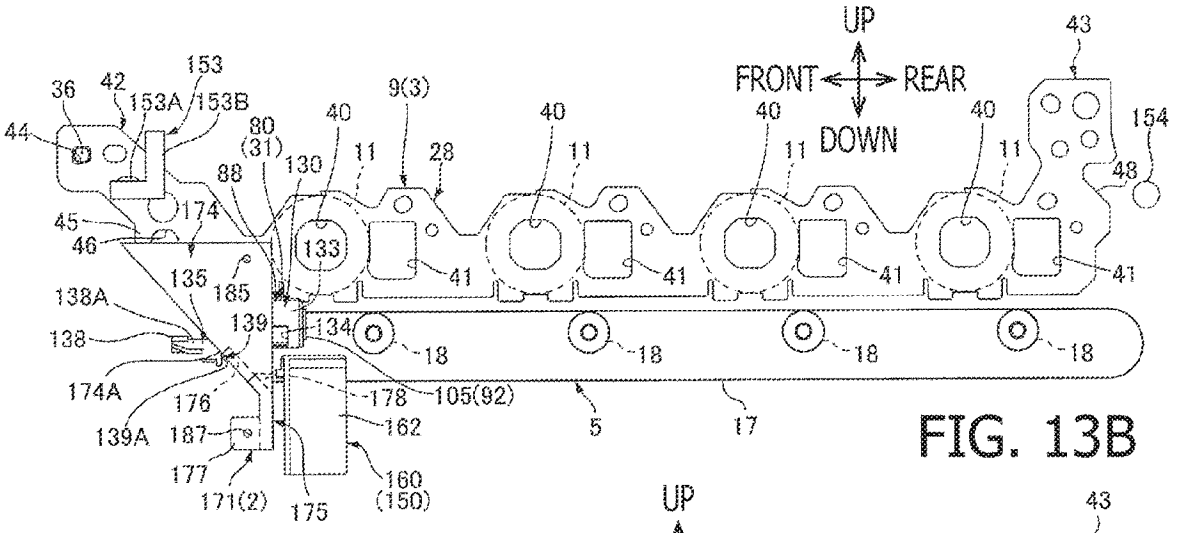
FIG. 13B is a right side view showing the state where the curved surface of the protruding section is guided in contact with the first sliding surface of the contact section, in the illustrative embodiment according to one or more aspects of the present disclosure.
Figure 13D:
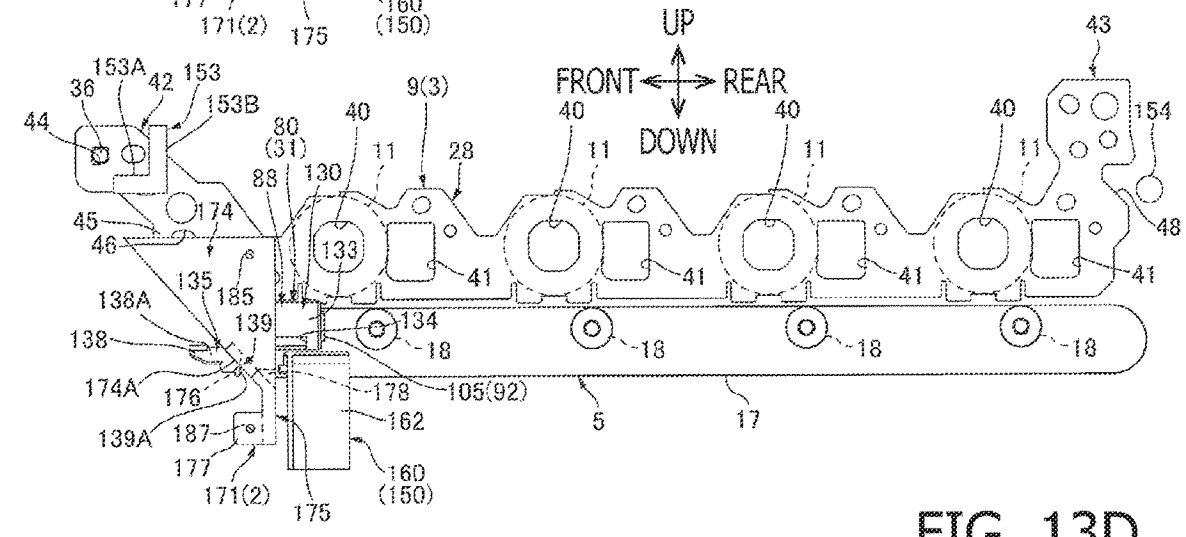
FIG. 13D is a right side view showing the state where the curved surface of the protruding section is guided in contact with the second sliding surface of the contact section, in the illustrative embodiment according to one or more aspects of the present disclosure.
Figure 13A:
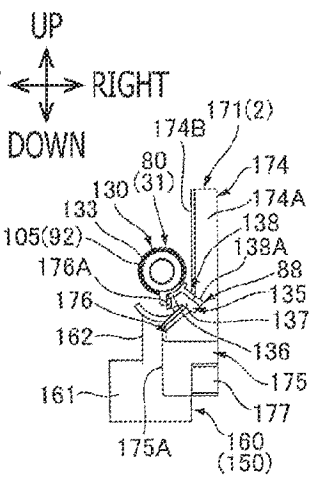
FIG. 13A is a front view showing a state where the curved surface of the protruding section is guided in contact with the first sliding surface of the contact section, in the illustrative embodiment according to one or more aspects of the present disclosure.

Subsequently, as shown in FIGS. 13A and 13B, the operator further pushes the drum unit 9 into the main body casing 2.

Thereby, the drum unit 9 moves rearward while being guided slightly downward by a guide (not shown) in the moving process.

The first sliding surface 174B is inclined downward in the rearward direction. Therefore, in response to the drum unit 9 being moved rearward, the protruding section 135 is further pushed downward while the curved surface 139A is being guided by the first sliding surface 174B.

Thereby, the shutter 130 further rotates clockwise in the front view.

Figure 13C:
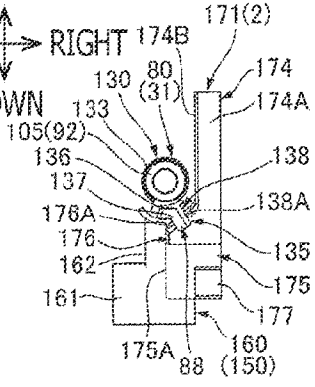
FIG. 13C is a front view showing a state where the curved surface of the protruding section is guided in contact with a second sliding surface of the contact section, in the illustrative embodiment according to one or more aspects of the present disclosure.

Subsequently, as shown in FIGS. 13C and 13D, the operator further pushes the drum unit 9 into the main body casing 2.

After being guided by the first sliding surface 174B of the contact section 171, the curved surface 139A of the protruding section 135 is separated away from the first sliding surface 174B and brought into contact with the second sliding surface 176A.

The second sliding surface 176A is inclined leftward in the rearward direction. Therefore, when the drum unit 9 moves rearward, the protruding section 135 is pushed toward a lower left side while the curved surface 139A is being guided by the second sliding surface 176A.

Thereby, the shutter 130 further rotates clockwise in the front view.

Figure 14B:
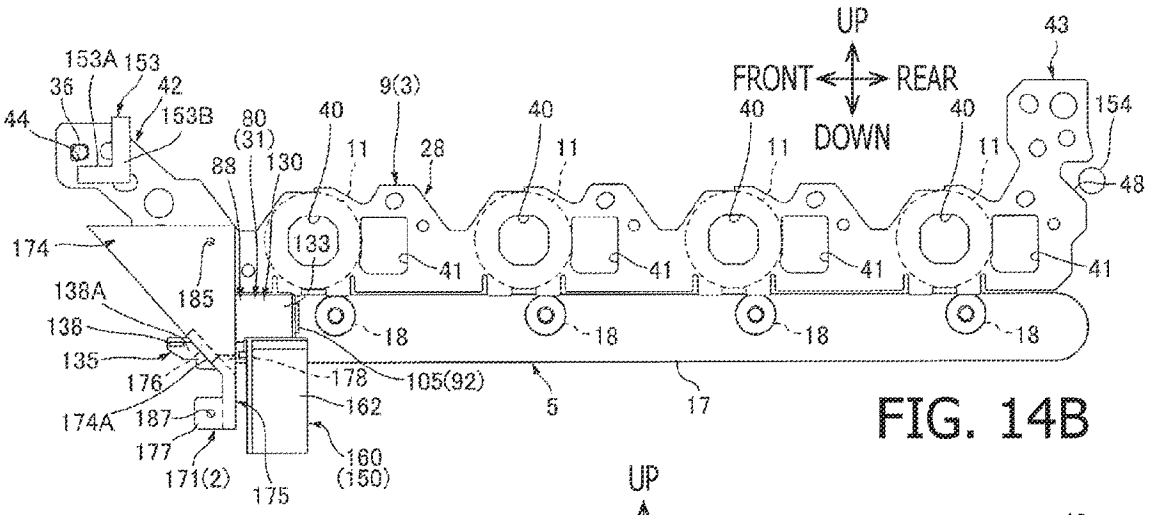
FIG. 14B is a right side view showing the state where the curved surface of the protruding section is in contact with the lower left end portion of the second sliding surface of the contact section, in the illustrative embodiment according to one or more aspects of the present disclosure.
Figure 14A:
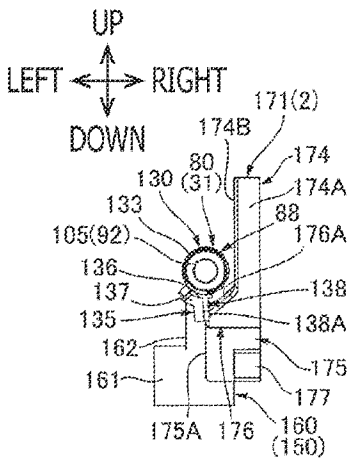
FIG. 14A is a front view showing a state where the curved surface of the protruding section is in contact with a lower left end portion of the second sliding surface of the contact section, in the illustrative embodiment according to one or more aspects of the present disclosure.
Figure 14D:
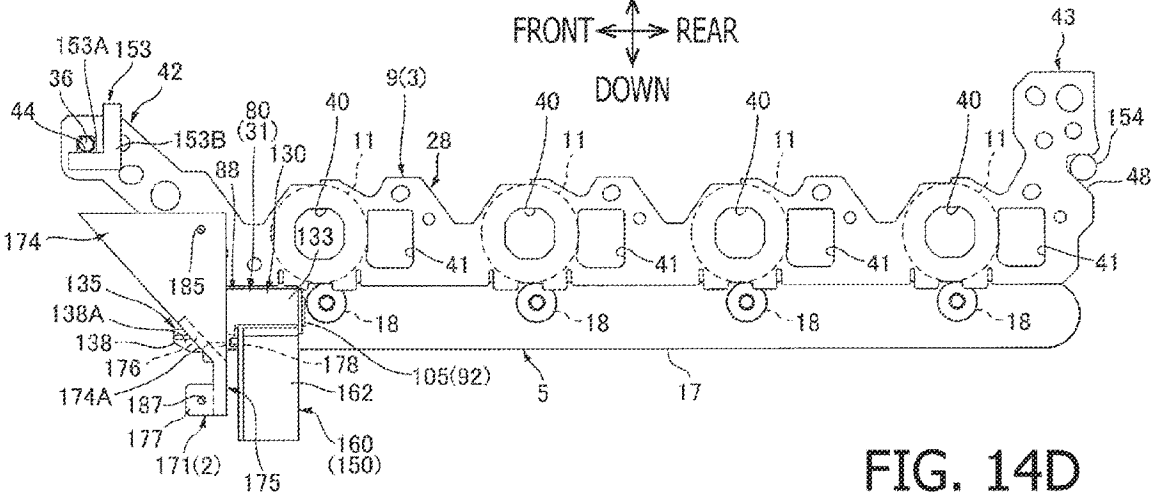
FIG. 14D is a right side view showing the state where the drum unit is in the second inside position within the inside position, in the illustrative embodiment according to one or more aspects of the present disclosure.

Subsequently, as shown in FIGS. 14A and 14B, the operator further pushes the drum unit 9 into the main body casing 2.

Thereby, the protruding section 135 is further pushed toward the lower left side while the curved surface 139A is being guided by the second sliding surface 176A.

Thereby, the shutter 130 further rotates clockwise in the front view.

At this time, in the front-to-rear direction, the unit reference shaft 36 of the drum unit 9 is positioned above the placement section 153A of the main body reference plate 153.

Further, the drum unit 9 accepts the main body reference shaft 154 in the notch 48 of the drum unit 9.

Figure 14C:
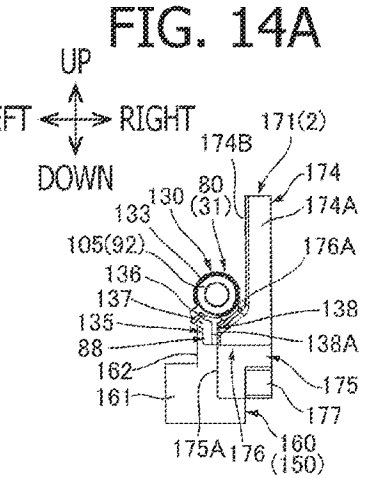
FIG. 14C is a front view showing a state where the drum unit is in a second inside position within the inside position, in the illustrative embodiment according to one or more aspects of the present disclosure.

Subsequently, as shown in FIGS. 14C and 14D, the operator further pushes the drum unit 9 into the main body casing 2.

Thereby, the drum unit 9 further moves toward the lower rear side inside the main body casing 2, and is placed in the second inside position within the inside position.

Thereby, the notch 48 of the first positioning plate 28 is fitted to a right end portion of the main body reference shaft 154. Although the following features are not shown in any drawings, the notch 48 of the second positioning plate 29 is fitted to a left end portion of the main body reference shaft 154. Further, a right end portion of the unit reference shaft 36 is placed on the placement section 153A of the right-side main body reference plate 153. Further, although the following features are not shown in any drawings, a left end portion of the unit reference shaft 36 is placed on the placement section 153A of the left-side main body reference plate 153.

A lower end portion of each photoconductive drum 11 is brought into contact with the upper portion of the belt 17.

Further, after the curved surface 139A is guided by the second sliding surface 176A of the contact section 171, the protruding section 135 is separated away from the second sliding surface 176A, and placed on a left side relative to the pressing plate 175 of the contact section 171.

Thereby, the pressed surface 138A of the protruding section 135 is brought into contact with the pressing surface 175A of the contact section 171.

Thus, when the contact section 171 presses the protruding section 135 leftward, the protruding section 135 is placed in the first position where the protruding section 135 extends downward. Thereby, as shown in FIGS. 4C and 10C, against the urging force from the urging member 131, the shutter 130 is placed in the open position where the communication port 134 is positioned below the shutter main body 133 and communicates with the outlet 107 of the third transportation tube 105 in the vertical direction. As shown in FIGS. 9 and 10C, the outlet 107 of the third transportation tube 105 is connected with an upper end portion of the second section 162 of the introduction tube 160 of the waste toner container 150. Through the outlet 107, the transportation tube 80 communicates with the upper end portion of the second section 162 of the introduction tube 160 of the waste toner container 150.

Further, the drum unit 9 is positioned in the left-to-right direction as the four positioned sections 143 contact the positioning section 157.

Then, when the operator closes the front cover 22, the main body couplings 155 are moved rightward by the known interlocking mechanism in conjunction with the front cover 22 being closed. Thus, each main body coupling 155 is fitted into the drum coupling 53 of the corresponding photoconductive drum 11.

Thereby, the drum unit 9 is completely attached.

Additionally, in order to move the drum unit 9 to the outside position, the operator operates the drum unit 9 in a reverse procedure to the aforementioned procedure.

Specifically, the operator first opens the front cover 22 of the main body casing 2.

In conjunction with the front cover 22 being opened, as shown in FIG. 7, the main body couplings 155 are moved leftward by the known interlocking mechanism. Thus, the main body couplings 155 are separated away from the drum couplings 53.

Subsequently, the operator holds the front handle 32A of the drum unit 9 and pulls the drum unit 9 frontward.

Thereby, the drum unit 9 is moved, slightly toward an upper front side, to the first inside position by the guide (not shown) of the main body casing 2.

Along with the movement of the drum unit 9, in a state where the shutter 130 is urged counterclockwise by the urging member 131 in a front view, the protruding section 135 is separated away from the pressing surface 175A of the contact section 171, and rotates counterclockwise in a front view while being guided by the second sliding surface 176A and the first sliding surface 174B.

Thereby, as shown in FIGS. 2 and 4A, the protruding section 135 is placed in the second position where the protruding section 135 extends rightward, and the shutter 130 is placed in the closed position where the outlet 107 is closed by the circumferential wall of the shutter main body 133.

Thereafter, as shown in FIGS. 12A and 12B, the protruding section 135 is separated away from the contact section 171, and the drum unit 9 is placed in the first inside position within the inside position.

Then, the operator further pulls the drum unit 9 frontward.

Thereby, the drum unit 9 is placed in the outside position, and the drum unit 9 is completely pulled out.

5. Cleaning Operation

Subsequently, an explanation will be provided of an operation of cleaning toner adhering to and remaining on the surface of each photoconductive drum 11.

As shown in FIG. 8, toner remaining on each photoconductive drum 11 in an image forming operation is scraped and removed by the blade 76 of the cleaning member 61 of the corresponding cleaner 30 when the blade 76 comes into contact with the photoconductive drum 11 in response to rotation of the photoconductive drum 11.

Then, the toner removed from the surface of each photoconductive drum 11 falls into the waste toner transporter 71 of the main body 66 of the frame 60. Namely, by the cleaning member 61, the toner remaining on the surface of each drum main body 50 is retrieved.

At this time, each cleaning transportation member 62 is rotating clockwise in a right side view, as the gear 78 engages with the second flange 52 of the corresponding photoconductive drum 11.

Thereby, the toner in each waste toner transporter 71 is transported rightward by the corresponding cleaning transportation member 62.

Then, as shown in FIG. 9, the toner transported rightward in each waste toner transporter 71 flows into the first transportation tube 95 via the insertion section 97 and the communication section 98 of the corresponding joint 96.

At this time, as shown in FIG. 7, the second transportation member 82 is rotating counterclockwise in a front view in response to a driving force from a driving gear (not shown) of the main body casing 2 being transmitted to the second gear 85.

Further, the first transportation member 81 rotates clockwise in a front view in response to the driving force from the driving gear (not shown) of the main body casing 2 being transmitted to the first gear 84 via the second gear 85.

Thereby, as shown in FIG. 9, the toner introduced into the first transportation tube 95 is transported frontward by the first transportation member 81.

Thus, the toner scraped and removed from the surfaces of the four photoconductive drums 11 is collected and transported frontward inside the first transportation tube 95.

Then, the toner transported to a front end portion of the first transportation tube 95 flows into the connecting tube 103 of the second transportation section 92.

At this time, when transported frontward by the first transportation member 81, the toner comes into contact with the rear surface of the closed section 93, moves by its own weight toward a lower right side inside the second transportation tube 104, and flows into the front end portion of the third transportation tube 105.

Subsequently, the toner introduced into the front end portion of the third transportation tube 105 is transported rearward by the second transportation member 82.

Thereby, the toner is transported to the outlet 107 inside the third transportation tube 105, and is discharged into the introduction tube 160 via the outlet 107.

Then, the toner is stored into the waste toner container 150 via the introduction tube 160.

Thus, through the aforementioned procedure, the operation of cleaning the toner remaining on the surface of the drum main body 50 of each photoconductive drum 11 is completed.

6. Operations and Advantageous Effects

According to the image forming apparatus 1, as shown in FIGS. 4B and 5A, in a state where the protruding section 135 protrudes rightward from the shutter main body 133, the shutter 130 is placed in the closed position. Then, in response to the drum unit 9 being moved from the outside position to the inside position, as shown in FIG. 6, the protruding section 135 is brought into contact with the contact section 171 of the main body casing 2. Thereby, the shutter 130 is moved from the closed position to the open position.

As shown in FIG. 9, the protruding section 135 is positioned upstream of the photoconductive drums 11 in a direction from the outside position toward the inside position of the drum unit 9 along the front-to-rear direction. Therefore, when the drum unit 9 is moved from the outside position to the inside position, the protruding section 135 is placed inside the main body casing 2 later than the photoconductive drums 11.

Then, when the drum unit 9 is moved from the outside position to the inside position, it is possible to prevent the protruding section 135 from coming into contact with the main body casing 2 earlier than the photoconductive drums 11. Thus, it is possible to prevent the shutter 130 from being placed in the open position before the photoconductive drums 11 are positioned inside the main body casing 2. Further, as shown in FIG. 10A, the protruding section 135 protrudes rightward from the shutter main body 133. Thus, it is possible to certainly bring the protruding section 135 into contact with the contact section 171 of the main body casing 2, and to certainly place the shutter 130 into the open position from the closed position.

Consequently, when the drum unit 9 is moved from the outside position to the inside position, it is possible to prevent the shutter 130 from being placed in the open position in an early stage of the movement of the drum unit 9. Thus, it is possible to prevent toner from leaking out of the transportation tube 80 and certainly transport the toner from the transportation tube 80 to the waste toner container 150.

Further, it is possible to shorten a moving distance of the protruding section 135 in the main body casing 2 when the drum unit 9 moves between the inside position and the outside position, as compared with when the protruding section 135 is positioned downstream of the photoconductive drums 11 in the direction from the outside position toward the inside position. Therefore, it is possible to save a space inside the main body casing 2.

Further, according to the image forming apparatus 1, as shown in FIG. 10A, the protruding section 135 protrudes rightward in a state where the shutter 130 is in the closed position. Therefore, when the drum unit 9 is moved from the outside position to the inside position, it is possible to certainly bring the protruding section 135 into contact with the contact section 171 of the main body casing 2.

Therefore, by the protruding section 135, it is possible to certainly place the shutter 130 into the open position from the closed position.

Further, according to the image forming apparatus 1, it is possible to position the photoconductive drums 11 by the first positioning plate 28 and the second positioning plate 29, and to position the protruding section 135 on a right side relative to the first positioning plate 28, as shown in FIG. 10A.

Therefore, when the drum unit 9 is moved from the outside position to the inside position, it is possible to more certainly bring the protruding section 135 into contact with the main body casing 2 and place the shutter 130 into the open position from the closed position.

Further, according to the image forming apparatus 1, as shown in FIG. 9, in a manner similar to the protruding section 135, the shutter 130 is positioned upstream of the photoconductive drums 11 in the direction from the outside position toward the inside position along the front-to-rear direction. Thereby, it is possible to avoid leakage of the toner in a position downstream of the photoconductive drums 11 in the same direction.

Further, according to the image forming apparatus 1, as shown in FIG. 9, the protruding section 135 is positioned upstream of the outlet 107 in the direction from the outside position toward the inside position along the front-to-rear direction. Thereby, it is possible to bring the protruding section 135 into contact with the contact section 171 of the main body casing 2, after placing the outlet 107 inside the main body casing 2.

Therefore, it is possible to certainly discharge the toner inside the main body casing 2.

Further, according to the image forming apparatus 1, as shown in FIGS. 5A and 5B, since the moving distance of the shutter 130 and the moving distance of the protruding section 135 are substantially equalized, it is possible to set the shutter 130 to certainly move between the open position and the closed position.

Further, according to the image forming apparatus 1, as shown in FIGS. 5A and 5B, the protruding section 135 is formed integrally with the shutter 130. Therefore, it is possible to certainly move the shutter 130 from the closed position to the open position in response to the protruding section 135 being brought into contact with the main body casing 2.

Further, according to the image forming apparatus 1, as shown in FIGS. 5A and 5B, it is possible to move the shutter 130 between the open position and the closed position, with such a simple configuration as to rotate the shutter 130 along a circumferential surface of the transportation tube 80.

According to the image forming apparatus 1, as shown in FIG. 6, when the drum unit 9 is placed in the inside position, the pressed surface 138A of the protruding section 135 is pressed by the pressing surface 175A of the contact section 171 of the main body casing 2. Thereby, the shutter 130 is placed in the open position. Further, as the positioned section 143 comes into contact with the positioning section 157, the drum unit 9 is positioned leftward relative to the main body casing 2.

Namely, the direction in which the pressing surface 175A of the contact section 171 presses the pressed surface 138A of the protruding section 135 to place the shutter 130 in the open position is the same as the direction in which the drum unit 9 is positioned relative to the main body casing 2.

Therefore, within the inside position, the shutter 130 is allowed to be placed in the open position by the contact with the contact section 171 of the main body casing 2. In addition, it is possible to certainly position the drum unit 9 relative to the main body casing 2.

Further, within the inside position, the shutter 130 is moved by the contact with the contact section 171 of the main body casing 2, from the closed position to the open position against the urging force from the urging member 131. At this time, a reaction force is applied leftward by the urging member 131. Therefore, it is possible to more certainly position the drum unit 9 relative to the main body casing 2.

Further, according to the image forming apparatus 1, as shown in FIGS. 12C and 12D, in response to the drum unit 9 being moved from the outside position to the inside position, the curved surface 139A of the protruding section 135 is caused to interfere with (e.g., is brought into contact with) the inclined surface 174A of the contact section 171. Thereby, it is possible to rotate the shutter 130.

Therefore, it is possible to place the shutter 130 in the open position by the movement of the drum unit 9 from the outside position to the inside position, without having to provide any additional mechanism for rotating the shutter 130.

Further, according to the image forming apparatus 1, as shown in FIG. 6, the direction in which the drum unit 9 is headed from the inside position to the outside position is perpendicular to the direction in which the drum unit 9 is positioned relative to the main body casing 2. Therefore, by pressing the pressed surface 138A of the protruding section 135 by the pressing surface 175A of the contact section 171, it is possible to certainly place the drum unit 9 in the inside position, without heading the drum unit 9 to the outside position.

Further, according to the image forming apparatus 1, as shown in FIGS. 5A and 5B, the protruding section 135 is formed in an L-shape. Thereby, it is possible to enhance the stiffness of the protruding section 135. Further, as shown in FIGS. 12C and 12D, it is possible to stably rotate the shutter 130 by causing the curved surface 139A of the curved section 139, which is a section continuous with the second plate 137 and the third plate 138 of the protruding section 135 having a high stiffness, to interfere with (i.e., contact) the inclined surface 174A of the contact section 171.

Further, according to the image forming apparatus 1, as shown in FIGS. 12C and 12D, the inclined surface 174A is inclined downward in a rearward direction. Therefore, while the curved surface 139A of the protruding section 135 is in contact with the inclined surface 174A of the main body casing 2, it is possible to move the protruding section 135 downward. Thus, it is possible to certainly rotate the shutter 130.

Further, according to the image forming apparatus 1, as shown in FIGS. 11A and 11B, the contact section 171 includes a guide surface formed by the first sliding surface 174B and the second sliding surface 176A. Therefore, the protruding section 135 is guided by the first sliding surface 174B, and thereafter guided by the second sliding surface 176A. Thereby, it is possible to guide the pressed surface 138A of the protruding section 135 to the pressing surface 175A of the main body casing 2, and to certainly place the shutter 130 in the open position.

Further, according to the image forming apparatus 1, as shown in FIGS. 12B and 14D, when moving from the outside position to the inside position, the drum unit 9 moves not only rearward but also downward, and is attached to the main body casing 2.

Therefore, it is possible to smoothly move the drum unit 9 relative to the main body casing 2.

Further, it is possible to prevent a force in a direction from the inside position toward the outside position from being applied to the drum unit 9. Thus, it is possible to more certainly position the drum unit 9 relative to the main body casing 2.

Further, according to the image forming apparatus 1, as shown in FIGS. 12A and 14C, the dimension of the inclined surface 174A in the vertical direction is larger than the moving distance, in the vertical direction, of the drum unit 9 moving from the first inside position to the second inside position. Therefore, by bringing the curved surface 139A of the protruding section 135 into contact with the inclined surface 174A of the main body casing 2, it is possible to certainly rotate the shutter 130.

Further, according to the image forming apparatus 1, as shown in FIGS. 5A and 5B, with such a simple configuration as to rotate the shutter 130 relative to the substantially cylindrical third transportation tube 105 of the transportation tube 80, it is possible to place the shutter 130 in the open position and the closed position.

Further, according to the image forming apparatus 1, as shown in FIG. 2, the drum unit 9 includes the four photoconductive drums 11, the four cleaners 30, and the transportation tube 80 that is connected with all of the cleaners 30 and has the outlet 107.

Therefore, it is possible to remove toner adhering onto the surface of each photoconductive drum 11 by the corresponding cleaner 30 and discharge the removed toner through the outlet 107 of the third transportation tube 105 of the transportation tube 80.

Further, according to the image forming apparatus 1, as shown in FIGS. 4B and 4C, with such a simple configuration as to urge the shutter 130 by the urging member 131 including a coil spring, it is possible to urge the shutter 130 toward the closed position.

Further, according to the image forming apparatus 1, as shown in FIG. 11A, the pressing surface 175A of the contact section 171 is a flat surface. In addition, as shown in FIG. 5A, the pressed surface 138A of the protruding section 135 is a flat surface. Thereby, as shown in FIG. 14C, it is possible to certainly press the pressed surface 138A by the pressing surface 175A.

Therefore, it is possible to certainly place the shutter 130 in the open position, and to certainly position the drum unit 9 relative to the main body casing 2.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

8. Modifications

Figure 15B:
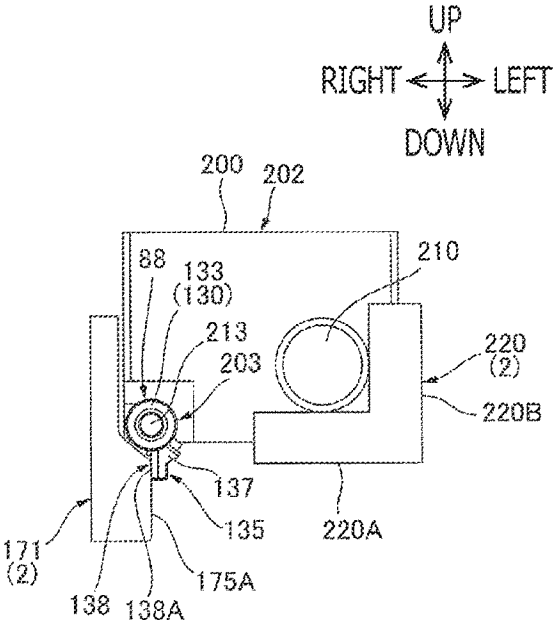
FIG. 15B is a rear view showing the process cartridge in the inside position, in the modification according to one or more aspects of the present disclosure.
Figure 15A:
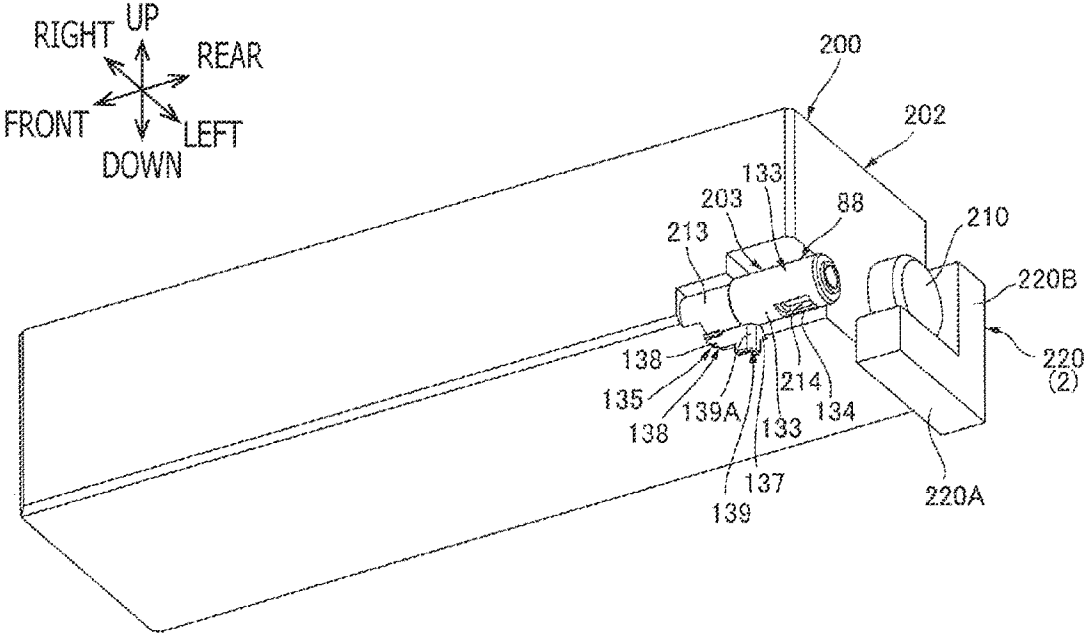
FIG. 15A is a perspective view, from a lower rear side, of a process cartridge in an inside position, in a modification according to one or more aspects of the present disclosure.

Referring to FIGS. 15A and 15B, a modification according to aspects of the present disclosure will be described. It is noted that, in the modification, the same elements as exemplified in the aforementioned illustrative embodiment will be provided with the same reference characters, and detailed explanations of the same elements will be omitted.

In the aforementioned illustrative embodiment, as shown in FIGS. 2 and 9, the drum unit 9 includes the plurality of photoconductive drums 11 and the plurality of cleaners 30.

In the drum unit 9, the toner removed from the surfaces of the photoconductive drums 11 by the cleaners 30 is transported to the waste toner container 150 by the transporter 31.

On the contrary, in the modification, as shown in FIGS. 15A and 15B, an image forming apparatus 1 includes a process cartridge 200. The process cartridge 200 is an example of a drum unit movable along the front-to-rear direction between an inside position inside a main body casing 2 and an outside position outside a main body casing 2.

Although the following features are not shown in any drawings, the process cartridge 200 includes therein a single photoconductive drum 11 and a single cleaner 30.

In the process cartridge 200, toner removed from a surface of the photoconductive drum 11 by the cleaner 30 is transported to a waste toner container 150 by a transporter 203.

The process cartridge 200 includes a housing 202 and the transporter 203.

The housing 202 is formed substantially in a box shape extending along the front-to-rear direction. The housing 202 is configured to accommodate toner therein. The housing 202 includes a positioned section 210.

The positioned section 210 is disposed at a rear end portion of the housing 202. The positioned section 210 is formed substantially in a cylindrical shape protruding rearward from a lower left end portion of a rear wall of the housing 202.

The transporter 203 is disposed at a lower right end part of a rear end portion of the process cartridge 200. The transporter 203 includes a shutter unit 88, and a transportation tube 213 having an outlet 214. The transportation tube 213 is an example of a frame. The outlet 214 is an example of an opening.

The transportation tube 213 is disposed at the lower right end part of the rear end portion of the process cartridge 200. The transportation tube 213 is formed substantially in a cylindrical shape that extends along the front-to-rear direction and has a closed rear end portion. A front end portion of the transportation tube 213 is communicably connected with the housing 202. In other words, an internal space of the transportation tube 213 communicates with an internal space of the housing 202 via the front end portion of the transportation tube 213.

The outlet 214 is disposed at a rear end portion of the transportation tube 213. The outlet 214 penetrates a lower circumferential wall of the transportation tube 213 in the vertical direction.

The shutter unit 88 has substantially the same configuration as exemplified in the aforementioned illustrative embodiment. The shutter unit 88 includes a shutter 103 configured to accept the transportation tube 213 in a shutter main body 133 of the shutter 103.

The main body casing 2 includes a main body reference plate 220.

The main body reference plate 220 is disposed at a rear end portion of the main body casing 2. The main body reference plate 220 includes a placement section 220A and an erected section 220B.

The placement section 220A is disposed at a lower end portion of the main body reference plate 220. The placement section 220A is formed substantially in a square poll shape extending along the left-to-right direction.

The erected section 220B is formed substantially in a square pole shape extending upward from a left end portion of the placement section 220A.

To attach the process cartridge 200 to the main body casing 2, in the same manner as exemplified in the aforementioned illustrative embodiment, the operator pushes the process cartridge 200 rearward via an opening 21 (e.g., see FIG. 1).

Then, the process cartridge 200 moves rearward inside the main body casing 2.

Thereby, the positioned section 210 of the process cartridge 200 is placed on the placement section 220A of the main body reference plate 220.

Further, in the same manner as exemplified in the aforementioned illustrative embodiment, in response to a protruding section 135 being brought into contact with a contact section 171 of the main body casing 2, the shutter 130 rotates clockwise in a front view, and is placed from a closed position to an open position.

Thereby, the outlet 214 of the transportation tube 213 is connected with an upper end portion of an introduction tube 160 of the waste toner container 150. Thus, the transportation tube 213 communicates with the upper end portion of the introduction tube 160 of the waste toner container 150 via the outlet 214.

Then, a pressed surface 138A of the protruding section 135 comes into contact with a pressing surface 175A of the contact section 171, and the contact section 171 presses the protruding section 135 leftward. Thereby, the positioned section 210 comes into contact with a right surface of the erected section 220B of the main body reference plate 220.

Thus, the process cartridge 200 is positioned relative to the main body casing 2.

The modification can provide the same advantageous effects as exemplified in the aforementioned illustrative embodiment.

What is claimed is:

1. An image forming apparatus comprising:

a main body casing;

a waste toner container: and a drum unit movable between an inside position inside the main body casing and an outside position outside the main body casing, the drum unit comprising:

a photoconductive drum having an axis extending in an axial direction intersecting a moving direction of the drum unit from the outside position toward the inside position;

a cleaner configured to remove toner remaining on a surface of the photoconductive drum; and a transporter configured to transport the toner removed by the cleaner toward the waste toner container, the transporter comprising:

a transportation member configured to transport the toner removed by the cleaner, along the moving direction of the drum unit;

a transportation tube configured to accommodate the transportation member, the transportation tube having an outlet configured to allow the toner transported by the transportation member to pass therethrough toward the waste toner container; and a shutter movable between a closed position to close the outlet and an open position to open the outlet, the shutter comprising:

a shutter main body; and a protruding section configured to protrude along the axial direction from the shutter main body when the shutter is in the closed position, the protruding section being positioned upstream of the photoconductive drum in the moving direction of the drum unit from the outside position toward the inside position, and the protruding section being movable relative to the outlet of the transportation tube together with the shutter main body when the shutter moves between the closed position and the open position.

2. The image forming apparatus according to claim 1, wherein the protruding section is further configured to, when the shutter is in the closed position, protrude outward from the shutter main body, along the axial direction.

3. The image forming apparatus according to claim 1, wherein the drum unit further comprises a positioning plate configured to position the photoconductive drum, and wherein, when the shutter is in the closed position, the protruding section is positioned outside the positioning plate in the axial direction.

4. The image forming apparatus according to claim 1, wherein the shutter is positioned upstream of the photoconductive drum in the moving direction of the drum unit from the outside position toward the inside position.

5. The image forming apparatus according to claim 1, wherein the shutter is positioned upstream of the outlet in the moving direction of the drum unit from the outside position toward the inside position.

6. The image forming apparatus according to claim 1, wherein a moving distance of the shutter from the closed position to the open position is substantially identical to a moving distance of the protruding section.

7. The image forming apparatus according to claim 1, wherein the protruding section is formed integrally with the shutter.

8. The image forming apparatus according to claim 1, wherein the transportation tube is formed in a cylindrical shape extending along the moving direction, and wherein the shutter is movable along a circumferential surface of the transportation tube, between the closed position and the open position.

9. An image forming apparatus comprising:

a main body casing having a first surface that faces in a first direction; and a drum unit movable between an inside position inside the main body casing and an outside position outside the main body casing, the drum unit being positioned relative to the main body casing in the first direction, the drum unit comprising:

a photoconductive drum;

a frame having an opening;

an urging member; and a shutter rotatable between a closed position to close the opening and an open position to open the opening, the shutter being urged from the open position toward the closed position by an urging force from the urging member, the shutter comprising:

a shutter main body; and a protruding section protruding outward from the shutter main body, the protruding section having a second surface configured to, when the shutter is in the open position, face in a second direction opposite to the first direction and be pressed by the first surface of the main body casing.

10. The image forming apparatus according to claim 9,
wherein the main body casing has a third surface that faces in a third direction in which the drum unit moves from the inside position toward the outside position, and
wherein the protruding section has a fourth surface that faces in a fourth direction opposite to the third direction when the shutter is in the closed position, the fourth surface being configured to, when the drum unit moves from the outside position to the inside position, interfere with the third surface.

11. The image forming apparatus according to claim 10, wherein the third direction is perpendicular to the first direction.

12. The image forming apparatus according to claim 11,
wherein the protruding section is L-shaped, the protruding section comprising:
a first section having the second surface, the first section extending along the third direction; and
a second section extending in a fifth direction from an upstream end portion of the first section in the third direction when the shutter is in the closed position, the fifth direction being perpendicular to the third direction, and
wherein a continuous joint portion between the first section and the second section has the fourth surface.

13. The image forming apparatus according to claim 12, wherein the third surface is inclined in the fifth direction as heading in the fourth direction.

14. The image forming apparatus according to claim 13, wherein the main body casing has a guide surface positioned between the first surface and the third surface, the guide surface being continuous with each of the first surface and the third surface, the guide surface being configured to guide the protruding section from the third surface to the first surface, the guide surface comprising:
a fifth surface continuous with the third surface, the fifth surface being inclined in the fifth direction as heading in the fourth direction; and
a sixth surface continuous with each of the fifth surface and the first surface, the sixth surface being inclined in the first direction as heading in the fourth direction.

15. The image forming apparatus according to claim 12,
wherein the drum unit is movable between a first inside position and a second inside position, within the inside position,
wherein the first inside position is a position in which the drum unit is placed when moving from the outside position into the main body casing, and
wherein the second inside position is a position in which the drum unit is placed when moving in the fifth direction from the first inside position.

16. The image forming apparatus according to claim 15, wherein a dimension of the third surface in the fifth direction is larger than a moving distance, in the fifth direction, of the drum unit to move from the first inside position to the second inside position.

17. The image forming apparatus according to claim 11,
wherein the frame is formed in a cylindrical shape extending along the third direction, and
wherein the shutter is rotatable around an axis extending along the third direction, between the closed position and the open position.

18. The image forming apparatus according to claim 9,
wherein the photoconductive drum is rotatable around an axis extending along the first direction,
wherein the drum unit comprises a cleaner configured to remove toner remaining on a surface of the photoconductive drum,
wherein the frame comprises a transportation tube connected with the cleaner, and
wherein the opening is an outlet.

19. The image forming apparatus according to claim 9, wherein the urging member comprises a coil spring.

20. The image forming apparatus according to claim 9, wherein each of the first surface and the second surface is a flat surface.

21. A drum unit comprising:
a first photoconductive drum having an axis extending in an axial direction;
a second photoconductive drum having an axis extending in the axial direction, the drum unit being movable along a moving direction between an inside position inside a main body casing and an outside position outside the main body casing, the moving direction being a direction along which the first photoconductive drum and the second photoconductive drum are arranged, the moving direction being a direction intersecting the axial direction;
a first cleaner configured to remove toner remaining on a surface of the first photoconductive drum;
a second cleaner configured to remove toner remaining on a surface of the second photoconductive drum; and
a transporter configured to transport the toner removed by the first cleaner and the toner removed by the second cleaner, the transporter comprising:
a transportation member configured to transport the toner removed by the first cleaner and the toner removed by the second cleaner, along the moving direction;
a transportation tube configured to accommodate the transportation member, the transportation tube having an outlet configured to allow the toner transported by the transportation member to pass therethrough; and
a shutter movable between a closed position to close the outlet and an open position to open the outlet, the shutter comprising:
a shutter main body; and
a protruding section configured to protrude along the axial direction from the shutter main body when the shutter is in the closed position, the protruding section being positioned upstream of each of the first photoconductive drum and the second photoconductive drum in the moving direction of the drum unit from the outside position toward the inside position, and the protruding section being movable relative to the outlet of the transportation tube together with the shutter main body when the shutter moves between the closed position and the open position.

22. The drum unit according to claim 21, wherein the protruding section is further configured to, when the shutter is in the closed position, protrude outward from the shutter main body, along the axial direction.

23. The drum unit according to claim 21, further comprising a positioning plate configured to position the first photoconductive drum and the second photoconductive drum, and
wherein, when the shutter is in the closed position, the protruding section is positioned outside the positioning plate in the axial direction.

24. The drum unit according to claim 21, wherein the shutter is positioned upstream of the first photoconductive drum and the second photoconductive drum in the moving direction of the drum unit from the outside position toward the inside position.

25. The drum unit according to claim 21, wherein the shutter is positioned upstream of the outlet in the moving direction of the drum unit from the outside position toward the inside position.

26. The drum unit according to claim 21, wherein a moving distance of the shutter from the closed position to the open position is substantially identical to a moving distance of the protruding section.

27. The drum unit according to claim 21, wherein the protruding section is formed integrally with the shutter.

28. The drum unit according to claim 21, wherein the transportation tube is formed in a cylindrical shape extending along the moving direction, and wherein the shutter is movable along a circumferential surface of the transportation tube, between the closed position and the open position.

29. A drum unit movable between an inside position inside a main body casing and an outside position outside the main body casing, the main body casing having a first surface that faces in a first direction, the drum unit being positioned relative to the main body casing in the first direction, the drum unit comprising:

a first photoconductive drum;

a second photoconductive drum;

a frame having an opening;

an urging member; and a shutter rotatable between a closed position to close the opening and an open position to open the opening, the shutter being urged from the open position toward the closed position by an urging force from the urging member, the shutter comprising:

a shutter main body; and a protruding section protruding outward from the shutter main body, the protruding section having a second surface configured to, when the shutter is in the open position, face in a second direction opposite to the first direction and be pressed by the first surface of the main body casing.

30. The drum unit according to claim 29, wherein the drum unit is configured to move in a third direction from the inside position to the outside position, along a particular direction in which the first photoconductive drum and the second photoconductive drum are arranged, wherein the drum unit is further configured to move in a fourth direction from the outside position to the inside position, along the particular direction, the fourth direction being opposite to the third direction, wherein the main body casing has a third surface facing in the third direction, and wherein the protruding section has a fourth surface facing in the fourth direction when the shutter is in the closed position, the fourth surface being configured to, when the drum unit moves from the outside position to the inside position, interfere with the third surface.

31. The drum unit according to claim 30, wherein the third direction is perpendicular to the first direction.

32. The drum unit according to claim 31, wherein the protruding section is L-shaped, the protruding section comprising:

a first section having the second surface, the first section extending along the third direction; and a second section extending in a fifth direction from an upstream end portion of the first section in the third direction when the shutter is in the closed position, the fifth direction being perpendicular to the third direction, and wherein a continuous joint portion between the first section and the second section has the fourth surface.

33. The drum unit according to claim 32, wherein the drum unit is movable between a first inside position and a second inside position, within the inside position, wherein the first inside position is a position in which the drum unit is placed when moving from the outside position into the main body casing, and wherein the second inside position is a position in which the drum unit is placed when moving in the fifth direction from the first inside position.

34. The drum unit according to claim 31, wherein the frame is formed in a cylindrical shape extending along the third direction, and wherein the shutter is rotatable around an axis extending along the third direction, between the closed position and the open position.

35. The drum unit according to claim 29, further comprising:

a first cleaner configured to remove toner remaining on a surface of the first photoconductive drum; and a second cleaner configured to remove toner remaining on a surface of the second photoconductive drum, wherein the first photoconductive drum is rotatable around a first axis extending along the first direction, wherein the second photoconductive drum is rotatable around a second axis extending along the first direction, wherein the frame comprises a transportation tube connected with the first cleaner and the second cleaner, and wherein the opening is an outlet.

36. The drum unit according to claim 29, wherein the urging member comprises a coil spring.

37. The drum unit according to claim 29, wherein each of the first surface and the second surface is a flat surface.

* * * * *